US005311260A

United States Patent [19]

Nakakuma et al.

[11] Patent Number: 5,311,260

[45] Date of Patent: May 10, 1994

[54] DEVELOPING DEVICE

[75] Inventors: Akira Nakakuma, Takaishi; Yasuyuki Fukunaga, Hirakata, both of Japan

[73] Assignee: Mita Industrial Co., Ltd., Osaka

[21] Appl. No.: 845,319

[22] Filed: Mar. 3, 1992

[51] Int. Cl.[5] ..... G03G 15/06

[52] U.S. Cl. ..... 355/245; 355/260; 355/327

[58] Field of Search ..... 355/245, 251, 253, 259, 355/326, 327, 260; 118/656, 657, 658; 141/270, 271, 272, 284; 222/DIG. 1

[56] References Cited

U.S. PATENT DOCUMENTS

| | | | |
|---|---|---|---|
| 4,622,916 | 11/1986 | Tanaka et al. | 355/245 X |
| 4,878,091 | 10/1989 | Morita et al. | 355/260 |
| 5,061,968 | 10/1991 | Kita | 355/326 |
| 5,138,398 | 8/1992 | Yamada | 355/326 |
| 5,142,325 | 8/1992 | Kai et al. | 355/326 X |
| 5,168,308 | 12/1992 | Hiraike et al. | 355/245 X |
| 5,182,584 | 1/1993 | Fukunaga et al. | 355/245 X |

*Primary Examiner*—A. T. Grimley
*Assistant Examiner*—Nestor R. Ramirez
*Attorney, Agent, or Firm*—Beveridge, DeGrandi, Weilacher & Young

[57] ABSTRACT

A movable frame is mounted on a stationary frame so as to be reciprocatingly moved in a predetermined direction by a moving means. The movable frame is equipped with a plurality of developing mechanisms which may be selectively located at a developing position by the motion of the movable frame to carry out multi-color developing. The developing mechanisms are urged toward a rotary drum. In order to prevent the developing agent from scattering, side sealing pieces are provided near the non-developing operation region on both sides of a sleeve member in a magnetic brush mechanism of each developing mechanism. A toner container unit including toner containers and toner feeding means is rotatably supported by the stationary frame. The toner feeding means includes a extensible and contractible means which is detachably coupled to the developing mechanism. The toner container unit is selectively brought to a predetermined fixed position relative to the developing mechanism and to a predetermined retracted position turned in a direction to separate away from the developing mechanism.

9 Claims, 17 Drawing Sheets

DEVELOPING DEVICE

FIELD OF THE INVENTION

The present invention relates to a developing device used for developing electrostatic latent image in an image-forming machine such as an electrostatic copier or an electrostatic printer. More particularly the invention relates to a multi-color developing device in a color image-forming machine.

DESCRIPTION OF THE PRIOR ART

Electrostatic color image-forming machines of various types have recently been proposed and put into practical use to meet the demand for color images. In the color image-forming machine of a typical example, electrostatic latent image for each of, for example, the four colors of yellow, magenta, cyan and black is formed on an electrostatic photosensitive material provided on a rotary drum and, then, the electrostatic latent image is developed by a developing device and is transferred onto a copying paper to form a color image on the copying paper. Such developing device in the color image-forming machine must be a multi-color developing device that is capable of selectively developing the electrostatic latent image in, for example, the above-mentioned four colors.

A known conventional multi-color developing device has been employed in a color image-forming machine as disclosed in, for example, Japanese Laid-Open Patent Publication No. 148055/1990. This multi-color developing device is mounted on a movable frame that is reciprocatingly moved in the up-and-down direction by a moving means, and includes a plurality of developing mechanisms. As the moving frame is moved up and down by the moving means, each of the developing mechanisms is selectively positioned in a developing zone of a rotary drum, where developing operation is carried out in an individually different color which is one of the aforementioned four colors. Each of the developing mechanisms are equipped with a developing housing and a toner container for containing a toner of an individually different color. The toner in the toner container is fed into the developing housing by a toner feeding means during the developing operation of the developing mechanism.

The above-mentioned conventional multi-color developing device has the following problems that must be solved.

(1) The toner container is provided for each of the developing mechanisms mounted on the moving frame and hence, requires a space for moving upwards. In consequence, the volume of the toner container is restricted, and the toner must be frequently fed to the toner container. Furthermore, the color image-forming machine becomes of a large size.

(2) The whole moving frame inclusive of the developing mechanisms becomes heavy in weight, the force of inertia due to movement increases and an increased load is exerted on the moving means. Therefore, it becomes very difficult to increase the speed of operation and time is required for changing the individual developing mechanisms. Moreover, a motor having a high capacity is required for moving the moving frame.

(3) Since the amount of the toner remaining in the toner container undergoes a change, the load exerted on the moving means changes at the time of driving or stopping the moving frame. Thus, it becomes difficult to ensure full accuracy in positioning of each of the developing mechanisms and in the timings of starting and stopping.

There has been further known a multi-color developing device in which the toner container is located over the developing mechanism and the toner is fed into the developing mechanism via a flexible tube with a built-in spiral. However, this device requires space for locating the toner container further over the uppermost position at which the developing mechanism has moved; i.e., the color image-forming machine as a whole becomes large-sized. Moreover, a considerable space which is useless is formed below the toner container.

In order to solve the above-mentioned problems inherent in the prior art, the present applicant has proposed an improved multi-color developing device in Japanese Patent Application No. 321401/1990 (U.S. patent application Ser. No. 07/794,588, European Patent Appln. Ser. No. 91 120 150.7).

The above multi-color developing device is constituted as described below. That is, the multi-color developing device includes a movable frame that is mounted on a stationary frame to reciprocatingly move in a predetermined direction by a moving means, and this movable frame is equipped with a plurality of developing mechanisms. The movable frame is moved by the moving means, whereby each of the developing mechanisms is selectively located at a predetermined developing position, and the developing operation is carried out in an individually different color.

Toner containers are provided in a number equal to that of the developing mechanisms, and a toner feeding means for feeding the toner in the toner container to the developing mechanism is provided between each of the toner containers and each of the developing mechanisms that correspond to the toner containers.

Each of the toner feeding means includes a cylindrical member that upwardly extends in a predetermined direction from the lower end portion of the toner container, a toner conveying means which is arranged inside the cylindrical member and extends alongthere and conveys to the upper end portion of the cylindrical member the toner that has been supplied into the cylindrical member from the lower end portion of the toner container, and a toner fall passage means which couples the upper end portion of the cylindrical member to the developing mechanism and feeds to the developing mechanism the toner conveyed to the upper end portion of the cylindrical member. Each of the toner conveying means is coupled to a drive source that is actuated by a toner feeding signal, and each of the toner fall passage means includes an extensible and contractible means that extends substantially along the direction in which the developing mechanism moves, the extensible and contractible means being so constituted as to extensibly and contractively extend in the direction in which the developing mechanism moves with the reciprocating motion of the movable frame.

The multi-color developing device constituted as described above is free from the aforementioned problems inherent in the prior art and has distinguished features compared with the prior art. The multi-color developing device, however, has the following problem that must be solved.

That is, the developing mechanism included in the multi-color developing device requires maintenance regularly or as required. The maintenance is conducted, for example, when the carrier contained in the developing housing of developing mechanism together with the toner is to be replaced or when a particular portion causes trouble. In such a case the developing mechanism must be taken out from the stationary frame together with the movable frame. The developing mechanism is taken out together with the movable frame by pulling it out over the upper portion of the stationary frame along a rail means that will be mentioned later. As described above the developing mechanism is coupled to the toner container via the extensible and contractible means (specifically, a bellows), and the toner feeding means that includes the extensible and contractible means is so positioned that a portion thereof prevents the developing mechanism from upwardly moving beyond a predetermined level. Therefore it is not allowed to separately take out only the movable frame that includes the developing mechanism: i.e., the toner container and the toner feeding means must be also taken out to take the movable frame out. Therefore, maintenance of the developing mechanism imposes an increased burden on a worker, and the operation efficiency is very poor.

For the purpose of convenience in explanation, the above-mentioned problem that must be solved is hereinafter referred to as the first problem to be solved.

The conventional multi-color developing device has other problems that are not only inherent therein but are also common to the monochromatic developing device. For instance, a multi-color developing device disclosed in Japanese Laid-Open Patent Publication No. 239571/1989 includes a plurality of developing mechanisms mounted on a movable frame that is reciprocatingly moved up and down by a moving means, like the aforementioned prior art. As the movable frame is moved up and down by the moving means, each of the developing mechanisms is selectively positioned at the developing zone of a rotary drum where an individually different color of the aforementioned colors is developed.

However, the above multi-color developing device is complex in construction and expensive, and has some more problems to be solved though they are not described herein. The present applicant has proposed an improved multi-color developing device in Japanese Patent Application No. 130395/1990. This improved multi-color developing device is free from the above-mentioned problem, but involves another problems that must be solved as described below.

That is, the above multi-color developing device proposed by the present applicant is comprised of a stationary frame, a movable frame mounted on the stationary frame so as to be reciprocatingly moved in a predetermined direction by a moving means, a plurality of developing mechanisms that are arranged on the movable frame at intervals in a predetermined direction and are so supported on the movable frame as to move over a predetermined range in a direction to approach and separate away from the rotary drum, and urging means disposed for each of the developing mechanisms to urge the developing mechanism in a direction to approach the rotary drum. Each of the developing mechanisms includes a developing housing and a developing agent application means mounted on each of the developing housings via a support shaft means. A pair of distance setting rollers are rotatably arranged on both sides of the developing agent application means. The movable frame is moved in the predetermined direction by the moving means and each of the developing mechanisms is selectively positioned at the predetermined developing position to develop colors which are different from each other.

When each of the developing mechanisms is selectively positioned at the predetermined developing position, the pair of distance setting rollers arranged for the developing mechanism of developing device located at the predetermined developing position are brought in contact with the surface of the rotary drum, and the developing mechanism located at the predetermined developing position is moved in a direction to separate away from the rotary drum while overcoming the urging action of urging means disposed for the developing mechanism. Thus, each of the developing mechanisms is selectively located at the predetermined developing position.

Side plates that constitute a part of the movable frame are arranged outside both sides of the developing mechanism (i.e., on both sides of the developing housing). Guide means are provided for the developing mechanism on the inside of both side plates of the movable frame. Each guide means is constituted by a guide groove that extends in a direction (back-and-forth direction) to approach and separate away from the rotary drum. The front end of the guide groove is closed, and the rear end and inner portion thereof are opened. A pair of guided pins are secured at a distance spaced in the back-and-forth direction outside both sides of the developing housing of developing mechanism. The guided pins are inserted in the corresponding guide grooves, whereby the developing mechanisms are supported by the movable frame to move in the back-and-forth direction. The rear open end of each guide groove is closed by a closing piece and an urging means (e.g., a compression coiled spring) is placed between the closing piece and one of the pair of guided pins The multi-color developing device that is constituted as described above has the following problem (hereinafter referred to as the second problem that must be solved). This problem is shared by the developing mechanisms and hence, will be described by referring to only one of the developing mechanisms. When one of the developing mechanisms is located at the predetermined developing position, the pair of distance setting rollers arranged for the developing mechanism are brought into contact with the surface of the rotary drum and the developing mechanism is moved in a direction to separate away from the rotary drum while overcoming the urging action of urging means that is disposed for the developing mechanism. Thus, the developing mechanism is located at the predetermined developing position. Under this condition the urging means pushes a portion of the developing housing of developing mechanism through one of the pair of guided pins. The developing housing is generally made of a synthetic resin, and the guided pins are secured to the developing housing. Therefore, the developing housing is liable to be distorted by pushing of the urging means.

When the developing housing undergoes flexure, the developing mechanism is not reliably pushed and is not often located at the predetermined developing position sufficiently precisely. Moreover a blade member is provided inside the developing housing The blade member has a function of forming a layer of developing agent, maintaining a predetermined thickness uniformly, on the surface of a rotary sleeve that constitutes a part of the developing agent application means. The blade member is provided in the developing housing and its tip maintains a small gap with respect to the surface of the sleeve This gap requires a high degree of precision to maintain the above function. If the developing housing is distorted, however, the gap undergoes a change and it becomes no more possible to uniformly maintain the thickness of the layer of developing agent on the surface of the rotary sleeve.

One of the pair of guided pins urged by the urging means is located behind the developing housing, i.e., the developing housing is urged from the back thereof. As a result the developing housing is liable to be moved in the thrust direction relative to the support shaft of the developing agent application means. This movement may become no more negligible depending upon the extent of back-lash caused by error in producing the parts.

The above-mentioned inconvenience develops not only in the above developing mechanism but also in other developing mechanisms having substantially the same constitution.

Because of the above-mentioned inconvenience the multi-color developing device is not capable of stably performing the developing action and as a result stable image can not be obtained. Moreover, the device as a whole loses durability to shorten the life and reliability is not maintained. So far as the above-mentioned constitution is possessed furthermore it is obvious that similar inconvenience develops not only in the multi-color developing device but also in the monochromatic developing device.

Moreover, the conventional multi-color developing device has still further problem that must be solved that is inherent not only in it but also in the monochromatic developing device. That is the multi-color developing device described above is provided with a plurality of developing mechanisms. Each developing mechanism has a developing agent application means which generally is comprised of a magnetic brush mechanism. Since the developing mechanisms have substantially the same constitution only one of them will be described below.

That is, the developing mechanism is comprised of a developing housing and a magnetic brush mechanism provided in the developing housing. The magnetic brush mechanism is constituted by a cylindrical sleeve member and a magnetic member arranged in the sleeve member. An opening is formed in the front surface of the developing housing, and the peripheral surface of the sleeve member in the magnetic brush mechanism is partly exposed through the opening. A developing agent consisting of a magnetic carrier and a toner or consisting of a magnetic toner only is contained in the developing housing. In the magnetic brush mechanism, the developing agent is held on the peripheral surface of the sleeve member by the magnetic attractive force of the magnetic member thereby to form a so-called magnetic brush of developing agent which is then moved passing through the opening. The developing agent forming the magnetic brush acts on the electrostatic latent image while passing through the opening: i.e., the toner is applied to the electrostatic latent image which is then developed into a toner image. The magnetic member in the magnetic brush mechanism is secured at a position of a predetermined angle and the developing agent forming the magnetic brush is moved as the sleeve member is rotated in a predetermined direction. Or, the sleeve member is secured and the magnetic member is rotated in a predetermined direction so that the developing agent moves on the sleeve member in a direction opposite to the rotational direction of the magnetic member.

In the magnetic brush mechanism, it is not allowed to extend the magnetic member over the whole sleeve member in the axial direction due to the limitation by the manner of mounting. The length of the magnetic member in the axial direction is generally slightly shorter than the length of the sleeve member in the axial direction. Therefore, the sleeve member has a developing operation region in which the magnetic member exists and further has on both sides thereof non-developing operation regions in which no magnetic member exists. In the developing operation region, the developing agent is held sufficiently strongly on the peripheral surface of the sleeve member owing to the magnetic attractive force of the magnetic member. In the non-developing operation regions where no magnetic member exists, however, the developing agent is not sufficiently strongly held on the peripheral surface of the sleeve member. In order that the developing agent is not allowed to be scattered around from the peripheral surface of the sleeve member, provision is made of an upstream sealing side member and a downstream sealing side member that come in contact with the non-developing operation regions on the peripheral surface of the sleeve member, on the upstream and downstream sides of both sides of the opening of the developing housing. The upstream sealing side members and the downstream sealing side members that are preferably made of a sponge are provided in order that the developing agent adhered to the peripheral surface of the sleeve member is inhibited not to be exposed through the opening after carried from the developing housing. In addition to the upstream sealing side members and the downstream sealing side members furthermore side sealing pieces are disposed extending along the peripheral surface of the sleeve member between the upstream sealing side member and the downstream sealing side member, so that the developing agent adhered on the peripheral surface of the sleeve member in the non-developing operation regions will not scatter around through the opening. The side sealing pieces are preferably made of a synthetic resin film.

In the above developing mechanism, however, the developing agent is not sufficiently prevented or inhibited from scattering, i.e., the developing agent is scattered in a vicinity of the non-developing operation regions on both sides of the sleeve member despite that the side sealing pieces as well as the upstream sealing side member and the downstream sealing side member in relation to the non-developing operation regions on both sides of the sleeve member are provided. The inventors have closely studied the scattering of the developing agent and have found that the developing agent scatters in a manner as described below. That is some amount of the developing agent adhered to the non-developing operation regions on both sides on the peripheral surface of the sleeve member is carried to the opening formed in the developing housing with the rotation of the sleeve member irrespective of the presence of the upper sealing side members (and lower sealing side members). No magnetic member exists in the sleeve member on the non-developing operation regions on both sides thereof, and the developing agent is not sufficiently strongly held on the peripheral surface of the sleeve member. Due to the centrifugal force created by the turn of the sleeve member, therefore, the developing agent carried to the opening escapes from the peripheral surface of the sleeve member in the non-operation regions on both sides thereof. The developing agent that has escaped is prevented from directly scattering in the radial direction by the side sealing piece that extends between the upstream sealing side member and the downstream sealing side member. However, there exists an unnegligible gap between the peripheral surface of the sleeve member and the side sealing piece, and part of the developing agent that has escaped moves inwardly in the axial direction beyond the side sealing piece from the inside thereof and is then scattered around.

So far as the developing mechanism possesses the above-mentioned constitution, it is obvious that a similar inconvenience takes place not only in the above multi-color developing device but also in the monochromatic developing device. The problem that must be solved of the developing mechanism that includes the above magnetic brush mechanism will be hereinafter referred to as the

SUMMARY OF THE INVENTION

The first object of the present invention which solves the above first problem is to provide an improved multi-color developing device which allows to conduct maintenance of the developing mechanism very efficiently, while retaining other excellent features.

The second object of the present invention which solves the above second problem is to provide an improved developing device which carries out developing operation stably and ensures to provide stable images notwithstanding that the developing mechanism is urged toward the rotary drum by the urging means.

The third object of the present invention which solves the above third problem is to provide an improved developing mechanism which is capable of sufficiently preventing or inhibiting the developing agent from scattering near the non-developing operation regions on both sides of the sleeve member without an increase in the manufacturing cost or in the size of the device.

In order to achieve the above first object according to the present invention, there is provided a multi-color developing device comprising a stationary frame, a movable frame mounted on said stationary frame so as to be reciprocatingly moved by a moving means in a predetermined direction, and a plurality of developing mechanisms mounted on said movable frame at a distance in said predetermined direction, by moving said movable frame by said moving means, said developing mechanisms being each selectively located at a predetermined developing position and the developing operation being carried out in an individually different color; wherein:

a toner container unit is rotatably supported by said stationary frame;

said toner container unit includes toner containers of a number equal to that of said developing mechanisms and toner feeding means that are provided between said toner containers and said developing mechanisms that correspond to said toner containers in order to feed the toner in said toner containers to said developing mechanisms;

each of said toner feeding means includes a toner fall passage means which feeds to said developing mechanism the toner that has been sent by a toner conveying means to an upper position in said predetermined direction, and said toner fall passage means includes an extensible and contractible means that is coupled to said developing mechanism via an attaching detaching means:

said extensible and contractible means is so positioned as to extensibly and contractively move substantially in a direction in which said developing mechanism moves, by the reciprocating motion of said movable frame; and said toner container unit is selectively brought to a predetermined fixed position relative to said developing mechanism and to a predetermined retracted position that is rotatingly moved in a direction to separate away from said developing mechanism.

In order to achieve the above second object according to the present invention, there is provided a developing device comprising a frame, a developing mechanism that is supported by said frame to move over a predetermined range in a direction to approach and separate away from a rotary drum, and an urging means which urges said developing mechanism in said direction to approach said rotary drum, wherein said developing mechanism includes a developing housing and a developing agent application means mounted on said developing housing via a support shaft means, a pair of distance setting rollers are rotatably arranged on both sides of said developing agent application means, said pair of distance setting rollers are brought into contact with the surface of said rotary drum by the urging action of said urging means to position said developing mechanism at a predetermined developing position with respect to said rotary drum, wherein said urging means urges said developing mechanism in said direction to approach said rotary drum via said support shaft means of said developing agent application means.

In order to achieve the above second object according to the present invention, furthermore, there is provided a multi-color developing device comprising a stationary frame, a movable frame mounted on said stationary frame so as to be reciprocatingly moved by a moving means in a predetermined direction, a plurality of developing mechanisms disposed in said movable frame at a distance in said predetermined direction and are so supported as to move over a predetermined range in a direction to approach and separate away from a rotary drum, and urging means disposed for each of said developing mechanisms to urge each of said developing mechanisms in the direction to approach said rotary drum, in which each of said developing mechanisms includes a developing housing and a developing agent application means mounted on said developing housing via a support shaft means, a pair of distance setting rollers are rotatably arranged on both sides of each of said developing agent application means, said movable frame is moved by said moving means in said predetermined direction and each of said developing mechanisms is selectively positioned at a predetermined developing position so that the developing operation is carried out in an individually different color, said pair of distance setting rollers arranged for said developing mechanism that is located at said predetermined developing position are brought into contact with the surface of said rotary drum when each of said developing mechanisms is located at said predetermined developing position, and then said developing mechanism located at said predetermined developing position is moved in said direction to separate away from said rotary drum against the urging action of said urging means disposed for said developing mechanism so that each of said developing mechanisms is selectively located at said predetermined developing position by turns, wherein each of said urging means urges each of said developing mechanisms in said direction to approach said rotary drum via each of said support shaft means.

In order to achieve the above third object according to the present invention, there is provided a developing mechanism comprising a developing housing having a front surface that is open, and a magnetic brush mechanism disposed in said developing housing, in which said magnetic brush mechanism is constituted by a cylindrical sleeve member that extends along said opening of said developing housing and a magnet member arranged in said sleeve member, part of the peripheral surface of said sleeve member is exposed through said opening of said developing housing, said magnet member extends in said sleeve member in the axial direction thereof, the length of said magnet member in the axial direction being shorter than the length of said sleeve member in the axial direction, said sleeve member has a developing operation region in which said magnet member exists and non-developing operation regions on both sides in which said magnet member does not exist a developing agent contained in the developing housing is moved in a desired direction passing said opening held on said developing operation region on the peripheral surface of said sleeve member being magnetically attracted by said magnet member, and at an upstream portion and a downstream portion on both sides of said opening of said developing housing are provided an upstream sealing side member and a downstream sealing side member that come in contact with said non-developing operation regions on the peripheral surface of said sleeve member as well as side sealing pieces that extend along the peripheral surface of said sleeve member between said upstream sealing side member and said downstream sealing side member, wherein a gap between the peripheral surface of said sleeve member and said side sealing pieces across said upstream sealing side member and said downstream sealing side member is set to be smaller than the thickness of the layer of the developing agent that is held on the developing operation region on the peripheral surface of said sleeve member and exposed through said opening.

DETAILED DESCRIPTION OF PREFERRED EMBODIMENTS

A multi-color developing device improved according to the present invention will now be described in detail by way of an embodiment with reference to the accompanying drawings. The multi-color developing device contains some characteristic constitutions. Among them, one characteristic constitution will first be described in conjunction with FIGS. 1 to 8.

Figure 1:
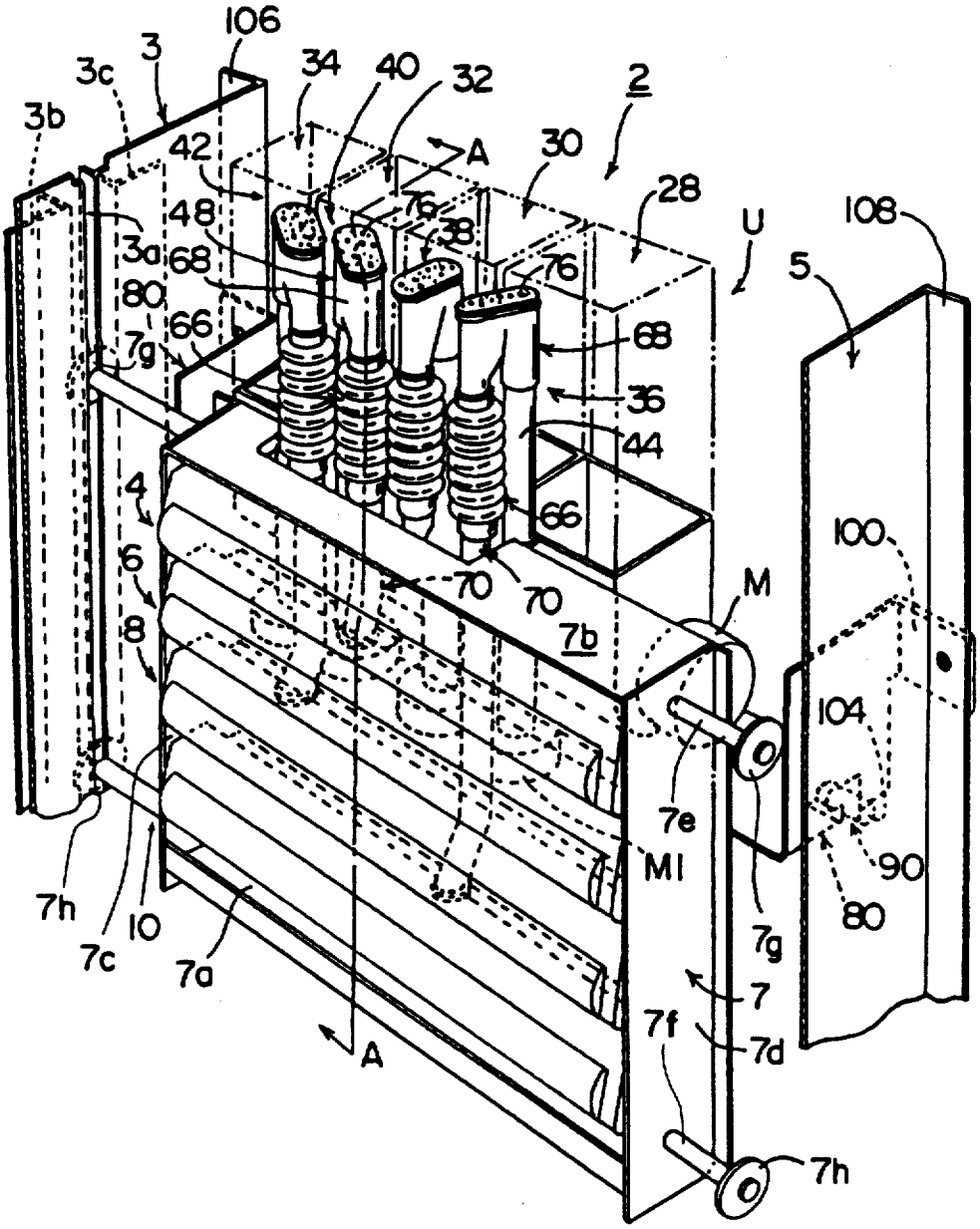
FIG. 1 is a perspective view which schematically illustrates an improved multi-color developing device according to an embodiment of the present invention.

In FIG. 1 the multi-color developing device which is generally designated at 2 is equipped with a pair of main frames 3 and 5 that constitute a part of a stationary frame, and a movable frame 7, which is a developing mechanism unit, so mounted on the stationary frame as to reciprocatingly move in a predetermined direction, i.e., in a vertical direction in this case, by a moving means that will be described later.

Figure 4:
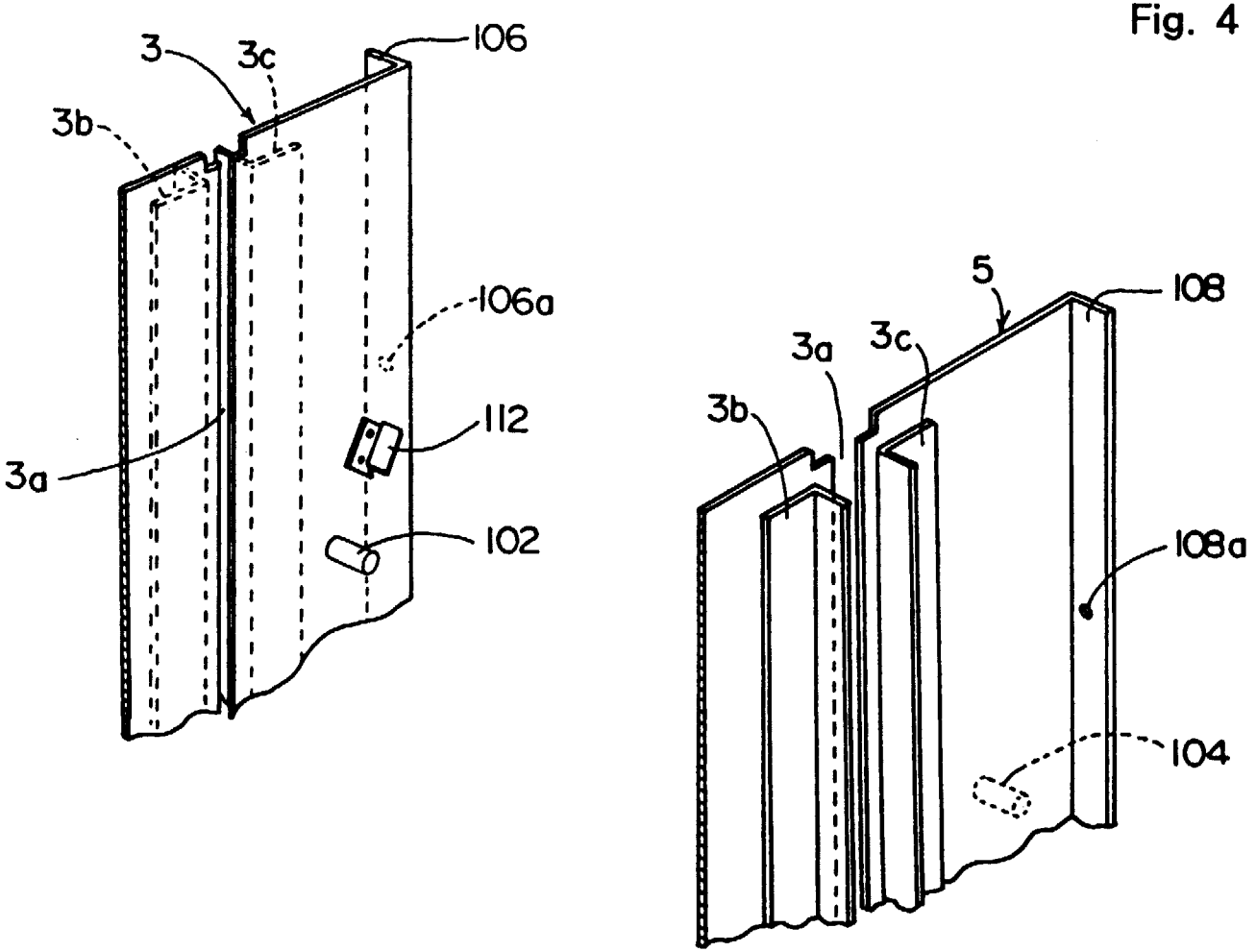
FIG. 4 is a perspective view which schematically illustrates portions to which the present invention is concerned in a main frame included in a stationary frame.

Referring to FIGS. 1 and 4, the stationary frame (not shown) is constituted by a housing which as a whole is of a rectangular parallelopiped shape, and the multi-color developing device 2 is disposed therein. The pair of main frames 3 and 5 constituting a part of the stationary frame are arranged extending substantially in a vertical direction at a distance in the back-and-forth direction (direction perpendicular to the surface of paper in FIG. 2). The main frames 3 and 5 have an opening 3*a* that extends in the vertical direction. The openings 3*a* are open at the upper ends of the in frames 3 and 5. A rail means is provided on the outer surfaces of the main frames 3 and 5. The rail means is constituted by rail members 3*b* and 3*c* that have an L-shape in cross section. The rail members 3*b* and 3*c* are secured to each of the main frames 3 and 5 to extend in parallel with each other along the openings 3*a* that is interposed therebetween. A guide rail is formed by the opposing surfaces of the rail members 3*b* and 3*c*.

The movable frame 7 is constituted by a bottom plate 7a, a top plate 7b, and a pair of side plates 7c and 7d. Both side portions of the bottom plate 7a and top plate 7b are coupled together by the pair of side plates 7c and 7d and the movable frame 7 as a whole is substantially of a rectangular shape. Shafts 7e and 7f are supported between the pair of side plates 7c and 7d at an upper end portion and a lower end portion. The ends of shafts 7e and 7f outwardly protrude beyond the side plates 7c and 7d, and rollers 7g and 7h are rotatably fitted to the protruded ends of the shafts. The rollers 7g and 7h are positioned inside the guide rails. The movable frame 7 supports four developing mechanisms that will be described later. The movable frame 7 is allowed to move reciprocatingly in the vertical direction, along the rail means, by the moving means that is mounted on the stationary frame and that will be described later.

The moving means (not shown) includes a threaded shaft provided in the stationary frame to extend in, for example, the vertical direction, a nut engaged with the threaded shaft, and a drive source for rotating the threaded shaft. The movable frame 7 is provided with a coupling bracket which is supported on the nut; whereby the movable frame 7 is so mounted on the stationary frame as to reciprocatingly move in the vertical direction by the moving means. That is, as the threaded shaft is rotated by the drive source, the nut moves along the threaded shaft. Therefore, the movable frame reciprocatingly moves in the vertical direction along the rail means via the coupling bracket. Constitutions concerned with the above moving means and rail means are disclosed in Japanese Patent Application No. 130395/1990 filed by the present applicant and are not described here in further detail.

Figure 2:
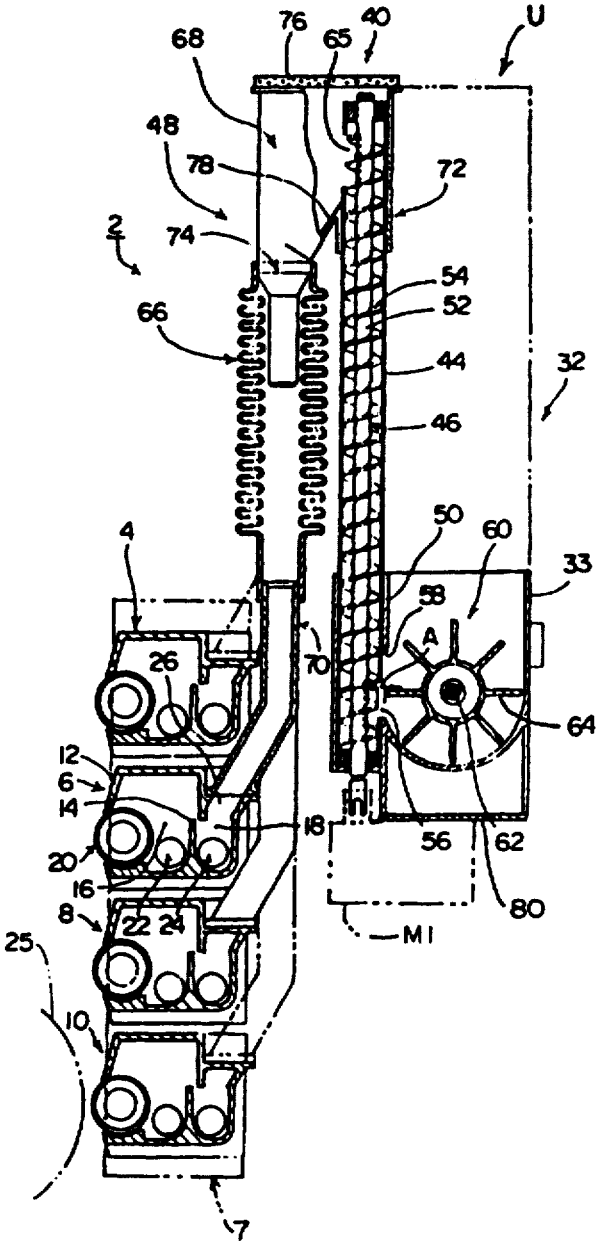
FIG. 2 is a schematic sectional view along the line A—A of FIG. 1.

In FIGS. 1 and 2 the movable frame 7 is provided with four developing mechanisms 4. 6. 8 and 10 in this order from the upper side in the vertical direction at a predetermined distance. The developing mechanism 4 holds a developing agent that contains a toner of cyan color; the developing mechanism 6, a developing agent that contains a toner of yellow color; the developing mechanism 8, a developing agent that contains a toner of magenta color; and the developing mechanism 10, a developing agent that contains a toner of black color. The developing agent consists of, for example, the toner and a carrier.

The developing mechanisms 4 to 10 are supported by the movable frame 7 to move in a direction to approach and to separate away from a rotary drum 25 that will be described later, and are urged in a direction to approach the rotary drum 25 as will be described later in detail.

The basic constitution of each developing mechanism is substantially the same except for some portions that will be described later. Therefore, description will be made here in regard to the developing mechanism 6, for example.

The developing mechanism 6 is provided with a developing housing 12 that has two chambers 16 and 18 formed by a partition wall 14 that extends in the back-and-forth direction (lengthwise direction) of the developing housing 12. The chambers 16 and 18 are communicated with each other at both end portions thereof through communicating passage (not shown). The developing housing 12 is provided with a developing agent application means that is mounted via a support shaft means 122 that will be described later. In this embodiment, the developing agent application means is constituted by a magnetic brush mechanism 19 as will be described later in detail with reference to FIGS. 17 to 19. The magnetic brush mechanism 19 is constituted by a cylindrical sleeve member 20 and a magnet member 21 disposed in the sleeve member 20. A spiral roller 22 which is a first stirring mechanism is disposed in the chamber 16 and a spiral roller 24 which is a second stirring mechanism is disposed in the chamber 18.

The sleeve member 20 is rotatably supported by the developing housing 12 and its peripheral surface is partly protruded (exposed) through an opening 13 (see FIGS. 17 and 18) that is formed along the left end (front surface) of the developing housing 12. When the developing mechanism 6 is located at a predetermined developing position, the above protruding portion of the peripheral surface of the sleeve member 20 approaches a developing zone of the rotary drum 25 (see a two-dot chain line in FIGS. 2 and 3) provided on the stationary frame, and the toner (yellow in this case) is applied onto the surface of the rotary drum 25 to thereby effect the developing operation.

The spiral rollers 22 and 24 are rotatably supported and extend in parallel with each other in the lengthwise direction of the chambers 16 and 18 of the developing housing 12. The sleeve member 20 and spiral rollers 22 and 24 are each coupled to a rotational drive source (not shown) via gear trains that will be described later so that they can be rotatingly driven simultaneously. As the spiral rollers 22 and 24 are rotated the developing agents in the chambers 16 and 18 are conveyed in a direction opposite to each other in the lengthwise direction. Thus, the developing agent in the developing housing 12 is circulated while being stirred.

A toner receiving port 26 is formed at an upper position of the chamber 18 of developing housing 12 to receive the toner fed from a toner feeding means which will be described later. The toner receiving port 26 is positioned in the upstream side of the spiral roller 24. The position at which the toner receiving port 26 is formed may differ according to the developing mechanisms. This difference is ascribed to the positional relationship with respect to the toner feeding mechanism as will be more easily comprehended from the description appearing later.

As described above, the movable frame 7 is moved by the moving means, whereby each of the developing mechanisms 4 to 10 is selectively located at the predetermined developing position to perform the developing operation in an individually different color. Control for movement of the movable frame 7 moved by the moving means and the developing operation may be done in a manner well known by people skilled in the art and so will not be described any further.

The stationary frame on the right end side of the movable frame 7 (right side in FIG. 2) is provided with a toner container unit U which includes toner containers 28. 30. 32 and 34 in a number equal to the number of the developing mechanisms 4 to 10 and toner feeding means 36, 38. 40 and 42, that will be described later, provided between the toner containers 28 to 34 and the developing mechanisms 4 to 10 that correspond to the toner containers 28 to 34 to feed the toners in the toner containers 28 to 34 to the developing mechanisms 4 to 10. The toner container unit U includes a support frame means 80 that is supported by a rotary support means to rotate with respect to the main frames 3 and 5 which constitute the stationary frame, as will be described later. The toner container unit U is supported to rotate relative to the main frames 3 and 5 so as to be selectively brought to a predetermined fixed position with respect to the developing mechanisms 4 to 10 and to a predetermined retracted position rotatingly moved in a direction to separate away from the developing mechanisms 4 to 10, as will be described later.

The support frame means 80 firmly supports the toner containers 28. 30. 32 and 34 in a number equal to the number of the developing mechanisms 4 to 10 arranged in a horizontal direction. Toner feeding means 36 to 42 are respectively provided between the toner containers 28 to 34 and the developing mechanisms 4 to 10 corresponding to the toner containers in order to feed the toners in the toner containers to the developing mechanisms. The toner container 28 and the toner feeding means 36 are provided in relation to the developing mechanism 10. Similarly, the toner container 30 and the toner feeding means 38 are provided in relation to the developing mechanism 4: the toner container 32 and the toner feeding means 40, to the developing mechanism 6; and the container 34 and the toner feeding means 42, to the developing mechanism 8. Therefore, the toner held in the toner container 28 is a black toner: that in the toner container 30 a cyan toner; that in the toner container 32, a yellow toner; and that in the toner container 34, a magenta toner.

The basic constitutions of the toner containers and the toner feeding means are substantially the same except their layouts. Therefore, the toner container 32 and the toner feeding means 40 provided in relation thereto will be described here for examples.

The toner feeding means 40 includes a cylindrical member 44 that extends in a predetermined direction, i.e.. upwardly in the vertical direction in this case, from the lower end portion of a container body 33 of the toner container 32; a spiral roller 46 as a toner conveying means that is disposed inside the cylindrical member 44 and extends along them and that is adapted to convey to the upper end thereof the toner that has been supplied to the cylindrical member 44 from the lower end portion of the toner container 32: a motor Ml which is a drive source coupled to the spiral roller 46; and a toner fall passage means 48 which couples the upper end portion of the cylindrical member 44 to the developing mechanism 6 and feeds the toner conveyed to the upper end of the cylindrical member 44 to the developing mechanism 6.

A cylindrical support portion 50 is formed at the side portion of the container body 33 (left side in FIG. 2), and the lower end portion of the cylindrical member 44 is inserted into and supported by, the support portion 50. The spiral roller 46 which is the toner conveying means is comprised of a shaft 52 rotatably supported by bearings at an upper end and a lower end of the cylindrical member 44 and a spiral member 54 formed on the shaft 52. The shaft 52 downwardly protrudes beyond the lower end of the cylindrical member 44, and is coupled to the motor M1. In this embodiment, the motor M1 and the shaft 52 are coupled together via a gear which is a power transmission means. The motor M1 is actuated upon receipt of toner feeding signals.

A toner inlet port 56 is formed at the lower end portion of the cylindrical member 44. A port 58 is also formed at the support portion 50 of the container body 33 that corresponds to the toner inlet port 56. A rotary blade 60 which is a rotary vane means is provided in the lower end portion (bottom portion) of the container body 33 to forcibly send the toner held in the container body 33 to the lower end portion of the cylindrical member 44. The rotary blade 60 is composed of a rotary shaft 62 which extends through the inside of the container body 33 and a plurality of blades 64 arranged to the rotary shaft 62.

The rotary blade 60 is coupled to a motor M which is a drive source. The motor M is controlled to be actuated upon receipt of, for example, a toner feeding signal an ON signal from the main switch of the copier, or a rotation signal for the sleeve of the developing mechanism. When the rotary blade 60 is rotated, the toner present in the bottom of the container body 33 is forcibly sent into the lower end portion of the cylindrical member 44 via port 58 and toner inlet port 56. In order to prevent the blocking of toner at the toner inlet port 56 the clearance A between the top end of the rotary blade 60 and the spiral member 54 (see FIG. 2) is set to be $0<A<10$ (unit in millimeters). Preferably this condition is set to be $0<A\leqq 2$. A toner outlet port 65 is formed at the upper end portion of the cylindrical member 44 so that the toner sent by the spiral roller 46 is permitted to flow into a coupling housing 68 that will be described later. In this embodiment, the motor M and the rotary shaft 62 are commonly used for other toner containers 28. 30 and 34. They, however, may be separately provided for each of them as a matter of course.

The toner fall passage means 48 includes a bellows 66 which is an extensible and contractible means. The bellows 66 is so arranged as to extend substantially in the moving direction (vertical direction) of the developing mechanism 6 at a predetermined fixed position, that will be described later, of the toner container unit U. That is, the bellows 66 is so positioned as to extensively and contractively move substantially in the moving direction of the developing mechanism 6 by the reciprocating motion of the movable frame 7. The toner fall passage means 48 further includes the coupling housing 68 that is arranged between the upper end portion of cylindrical member 44 and the upper end portion of bellows 66 to permit the toner sent to the upper end of the cylindrical member 44 to fall into the bellows 66.

The coupling housing 68 has a cylindrical portion 72 into which the upper end portion of the cylindrical member 44 is inserted for connection at a lower part of the end portion thereof and has at the other end portion, another cylindrical portion 74 in which is inserted the upper end portion of the bellows 66. The cylindrical portion 74 protrudes into the bellows 66 and is open therein. The cylindrical portions 72 and 74 extend substantially downwardly in the vertical direction. A flat opening portion is formed in the upper end portion of the coupling housing 68, and a filter 76 which is a ventilation means is mounted so as to cover the opening. It is important that the filter 76 permits the air to ventilate (intake/exhaust) between the interior of the toner fall passage means 48 and the atmosphere but does not permit the toner to discharged. The filter 76 may, for example, be the one produced by Kanai Heavy Industries, Ltd, and is placed on the market under the trade name (Model) HF 180. Further it is important that the filter 76 is provided at a portion where the toner adheres least or at a portion where the toner exists in least amounts in the toner fall passage means 48. In this embodiment, therefore, the filter 76 is provided at the top end position of the toner fall passage means 48. It is of course allowable to provide the filter 76 which is the ventilation means in any part of the coupling housing 68, bellows 66, or coupling pipe means 70 in the toner fall passage means 48.

In the coupling housing 68 is formed a tilted surface 78 extending from the lower end of the toner outlet port 65 to the another cylindrical portion 74 such that the toner introduced from the toner outlet port 65 formed at the upper end portion of the cylindrical member 44 can easily fall into the another cylindrical portion 74.

The developing mechanism 6 is provided with the coupling pipe means 70 which is coupled at its upper end portion to the lower end portion of the bellows 66 via an attach/detach means 114 that will be described later and is coupled at its lower end portion to the developing housing 12 of developing mechanism 6. The lower end portion of the coupling pipe means 70 is situated above the toner receiving port 26 in the developing housing 12, and is open on the toner receiving port 26.

As will be apparent from FIG. 2, the bellows 66 is so disposed that the axis thereof is directed in the vertical direction. Therefore, the bellows 66 can extend or contract in the vertical direction, without being folded, by the reciprocating motion of the movable frame 7 (i.e., developing mechanism 6). As shown in FIG. 2, the axis of the bellows 66 in this embodiment is located between the right end of the developing mechanism 6 and the cylindrical member 44. Therefore, the coupling pipe means 70 has a vertical portion whose axis is in agreement with the axis of the bellows 66 and a tilted portion extending from the vertical portion toward the toner receiving port 26 of the developing housing 12.

In relation to other toner feeding means 36 38 and 42, the developing mechanisms 10. 4 and 8 related thereto have different heights as shown, and accordingly, the coupling pipe means 70 must have different lengths to correspond thereto. Furthermore, the bellows 66 may be so constituted that the axis thereof is positioned just above the toner receiving port 26 in regard to only the developing mechanism 4 located at the uppermost position.

Operation of the thus constituted multi-color developing device 2 will now be described. Here, the operation is carried out under the condition where the toner container unit U is located at a predetermined fixed position with respect to the developing mechanisms 4 to 10.

Figure 3:
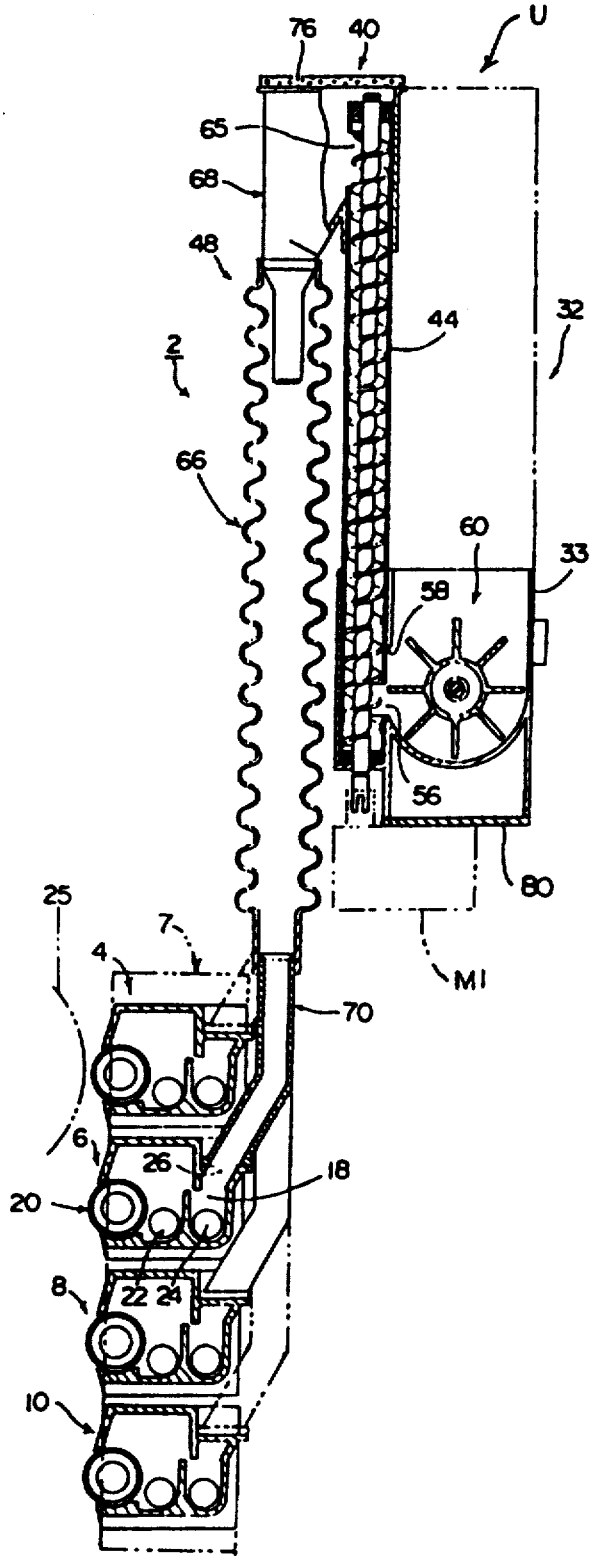
FIG. 3 is a view illustrating mother another operation state in FIG. 2.

In accordance with the copying operation of, for example, a color image copier (not shown) that includes the multi-color developing device 2, the movable frame 7 moves reciprocatingly in the vertical direction along the rail means by the moving means. The movable frame 7 is controlled by a control means that is well known among people skilled in the art, so that the developing mechanisms 4 to 10 are selectively located at a predetermined developing position to perform a developing operation in individually different color. FIG. 2 shows the condition in which the movable frame 7 is located at the uppermost position and the developing mechanism 10 at the lowermost position of the movable frame is positioned at the developing position. FIG. 3 shows the condition in which the movable frame 7 has moved to the lowermost position and the developing mechanism 4 at the uppermost position in the movable frame 7 is positioned at the developing position.

The developing operations of each of the developing mechanisms 4 to 10 and the operations of the associated toner feeding means 36 to 42 are substantially the same. Therefore described below are the developing operation concerned with the developing mechanism 6 whose constitution was mentioned above and the operation of the associated toner feeding means 40.

The developing mechanism 6 that is not positioned at the predetermined developing position (the movable frame 7 is in motion or is at rest), is under the non-operating condition. The sleeve 20 and spiral rollers 22 and 24 in the developing mechanism 6 are at rest. Since no toner feeding signal is generated by the developing mechanism 6 none of the motor M1 for the spiral roller 46 and the motor M for the rotary vane means 60 are operated, and the spiral roller 46 and the rotary vane means 60 are at rest. Therefore, the toner in the toner container 32 is not fed to the developing mechanism 6. The developing mechanism 6 is placed under the operating condition when it is brought to the predetermined developing position by the movement of the movable frame 7 that is driven by the moving means. The sleeve 20 and spiral rollers 22 and 24 in the developing mechanism 6 are rotated by the drive source, and the known developing operation is carried out for the rotary drum. Here, since the toner feeding signal is generated by the developing mechanism 6, the motor M1 for the spiral roller 46 and the motor M for the rotary vane means 60 are actuated. Thus, the spiral roller 46 and the rotary vane means 60 are rotated. The toner in the container body 33 is conveyed to the lower end portion of the cylindrical member 44 by the rotary vane means 60 via port 58 and toner inlet port 56. The toner supplied into the lower end portion of the cylindrical member 44 is carried to the upper end portion thereof by the spiral roller 46, and is allowed to flow into the coupling housing 68 from the toner outlet port 65. The toner that flew into the coupling housing 68 falls along the tilted surface 78 and further through the bellows 66 and coupling pipe means 70, and is fed into the chamber 18 of developing mechanism 6 through the toner receiving port 26 of the developing housing 12.

When the predetermined developing operation of the developing mechanism 6 is completed the movable frame 7 starts movement, whereby one of the developing mechanisms 4. 8 and 10 is selected and is brought to the predetermined developing position. Then the operation substantially the same as the one mentioned above is carried out by any of the developing mechanisms 4, 8 and 10. During this period, the developing mechanism 6 has been returned back to the non-operating condition.

Irrespective of whether the developing mechanism 6 is in operation or not in operation, the bellows 66 is extended or contracted in the moving direction (vertical direction in this embodiment) of the developing mechanism 6 with the motion of the movable frame 7 without being folded. The extension and contraction operation produces an intake air pressure and an exhaust air pressure in the toner fall passage means 48 that includes bellows 66 and these pressures are controlled through the filter 76 provided at the uppermost end of the coupling housing 68. The air only is exhausted through the filter 76 at the time of exhaust and the toner is trapped by the filter 76 and does not scatter in the atmosphere. This operation is similarly carried out by any of the other toner fall passage means.

Next described below is the constitution in which the toner container unit U is selectively brought to the predetermined fixed position and the predetermined retracted position.

As described above, the toner container unit U includes the support frame means 80 that is supported by a rotary support means that will be described later to rotate with respect to the main frames 3 and 5 which constitute the stationary frame. The support frame means 80 is maintained at a predetermined fixed position with respect to the main frames 3 and 5 by a fixing means that will be described later, and is allowed to turn into a predetermined retracted position when the fixing means is released. The predetermined retracted position is defined by a stop means that is provided between the support frame means 80 and the main frames 3, 5 and that will be described later. They will now be described in detail.

Figure 5:
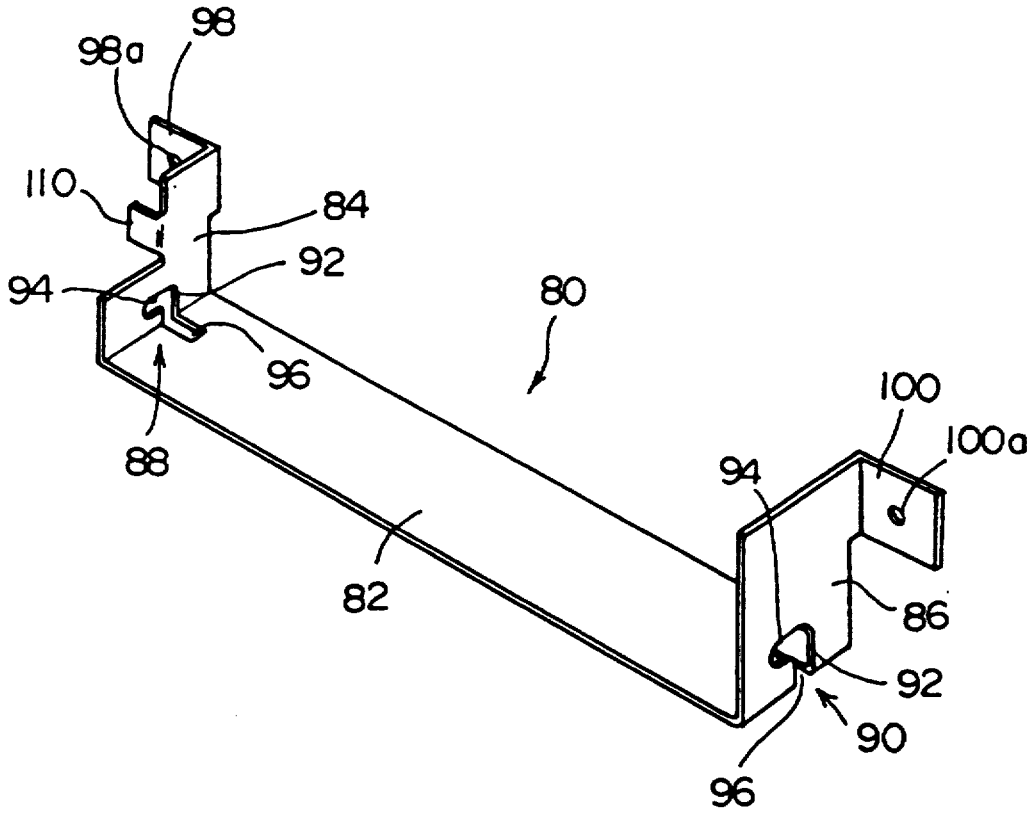
FIG. 5 is a perspective view of a support frame means.
Figure 6:
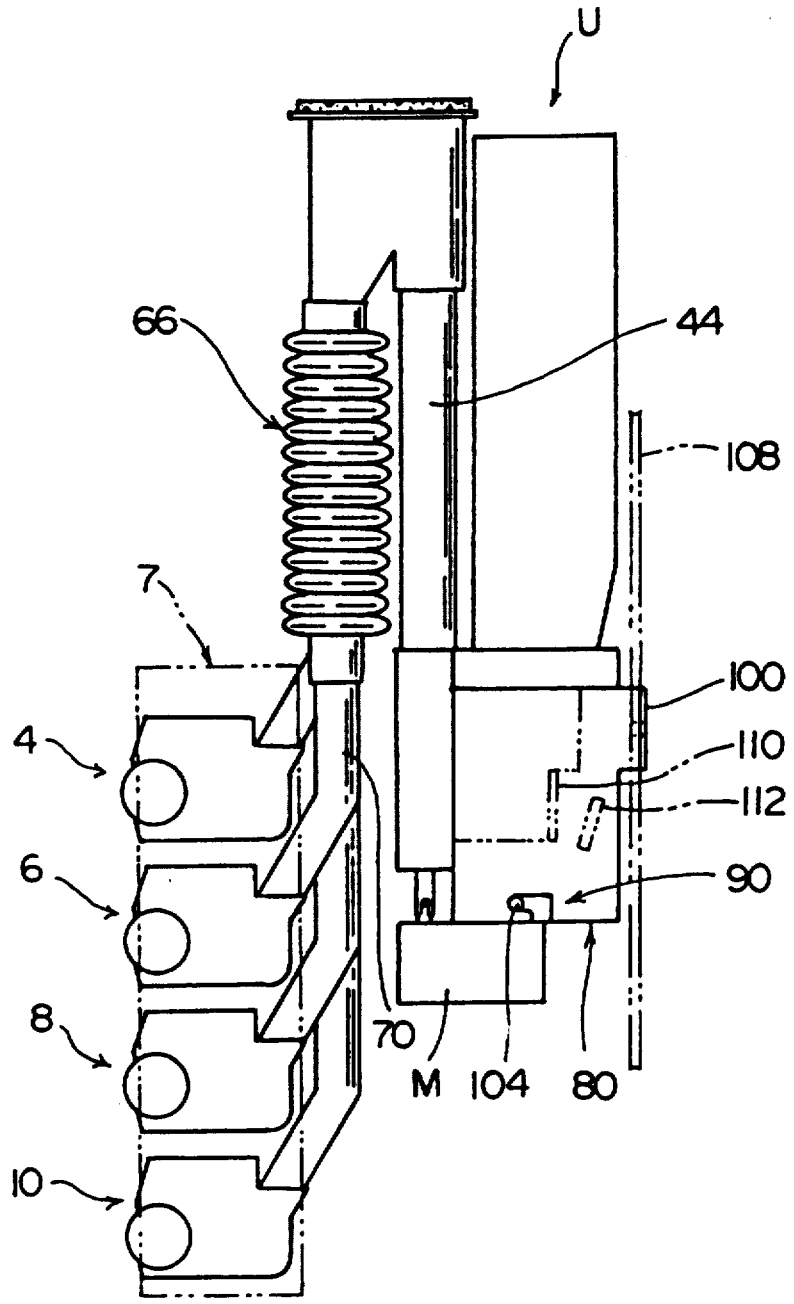
FIG. 6 is a schematic side view showing the condition where a toner container unit is located at a predetermined fixed position.

In FIG. 5 the support frame means 80 in this embodiment is made of a steel plate, and includes a substantially flat base portion 82 that extends in the lengthwise direction and side walls 84 and 86 that extend upwardly substantially in a perpendicular direction from both sides of the base portion 82. Support hole means 88 and 90 are formed at lower positions of the side walls 84 and 86. Here, the support hole means 88 and 90 have substantially the same constitution, and the same portions are denoted by the same reference numerals. Each of the support hole means 88 and 90 has a vertically elongated hole 92 that upwardly extends from a lower position of the side wall 84 or 86; a laterally elongated hole 94 that is formed continuously to the vertically elongated hole 92 and extends towards the developing mechanisms 4 to 10 (leftwards in FIG. 6) from the vertex of the vertically elongated hole 92; and a lengthwisely elongated hole 96 that is formed continuously to the vertically elongated hole 92 and extends inwardly in the lengthwise direction from the side portion of base portion 82. Contact portions 98 and 100 are formed, by being bent, at upper ends in the lateral direction (right-and-left direction in FIG. 6) of side walls 84 and 86 of the support frame means 80 the contact portions 98 and 100 extending substantially vertically and outwardly. Mounting holes 98*a* and 100*a* are formed in the contact portions 98 and 100.

As shown in FIGS. 1 and 4, the main frames 3 and 5 extend substantially in the vertical direction on the outside of side walls 84 and 86 of the support frame means 80. Support pin means 102 and 104 are fixed to the main frames 3 and 5 to protrude toward the side walls 84 and 86 of the support frame means 80. The support frame means 80 is rotatably supported to the main frames 3 and 5 by bringing its support hole means 88 and 90 into engagement with support pin means 102 and 104. Therefore, the rotary support means is constituted by support pin means 102. 104 and support hole means 88. 90.

Under the condition where the support frame means 80 is supported by the main frames 3 and 5 via support pin means 102 and 104, the lengthwisely elongated hole 96 has a length from the side wall 84 or 86 that is longer than the length of support pin means 102 or 104 that protrudes in the lengthwise direction beyond the side wall 84 or 86.

The main frames 3 and 5 have, at their ends, contacting portions 106 and 108 that extend substantially perpendicularly to the main frames 3 and 5 and in the directions opposite to each other so as to be corresponded to the contact portions 98 and 100 formed on the side walls 84 and 86 of support frame means 80. Threaded mounting holes 106*a* and 108*a* are formed in the contacting portions 106 and 108. Under the condition where the support frame means 80 is supported by the main frames 3 and 5 via rotary support means, the contacting portions 106 and 108 are brought into contact with the contact portions 98 and 100 at an outer position (right position in FIG. 6) in a direction to separate away from the developing mechanisms 4 to 10. Under this contacting condition, the mounting holes 98*a* and 100*a* are substantially on the same axis as the corresponding threaded mounting holes 106*a* and 108*a*. By utilizing these holes, the contact portions 98 and 100 are releasably fastened to the contacting portions 106 and 108 by means of screws (not shown) which constitute a fixing means. With the contact portions 98 and 100 being fastened to the contacting portions 106 and 108, a predetermined fixing position of the toner container unit U is determined.

Referring to FIG. 5, a protrusion means 110 is formed by being bent from at least either one of the side wall 84 or 86 of support frame means 80 i.e., from the side wall 84 in this embodiment to extend substantially perpendicularly to the side wall 84 toward the outside in the lengthwise direction. As shown in FIG. 4 furthermore, the main frame 3 that corresponds to the side wall 84 provided with protrusion means 110 has an engaging means 112 that protrudes toward the side wall 84 provided with protrusion means 110. The engaging means 112 in this embodiment is formed by bending a steel plate and is detachably fastened to a predetermined position of the main frame 3 using, for example, screws. A stop means is constituted by protrusion means 110 and engaging means 112. When the above-mentioned fixing means is released and the support frame means 80 is rotated by a predetermined angle with respect to the support pin means 102 and 104 the protrusion means 110 in the stop means comes in contact with the engaging means 112. Thus, a predetermined retracted position of the toner container unit U is defined. A predetermined retracted position of the support frame means 80 is accomplished by the weight of the toner container unit U as will be described later.

Described below is the action of the toner container unit U in relation to the predetermined fixed position and the predetermined retracted position.

The predetermined fixed position of the toner container unit U is shown in FIGS. 1 to 3 and 6. The fixed position is set as described below. Under the condition where the position is not set, coupling of the bellows 66 of the toner container unit U to the coupling pipe means 70 of the developing mechanisms 4 to 10 is not made by an attaching/detaching means 114 that will be described later. First, the toner container unit U is positioned between the main frames 3 and 5 under the condition where it is being tilted rightwardly in FIG. 6. Then, the lengthwisely elongated holes 96 of the support frame means 80 are passed the support pin means 102 and 104, and the vertically elongated holes 92 are fitted to the support pin means 102 and 104. The toner container unit U is supported by the support pin means 102 and 104 under this condition. The toner container unit U under this condition is moved in a direction to separate away from the developing mechanisms 4 to 10 (rightwardly in FIG. 6), and rearmost portions of the laterally elongated holes 94 are fitted to the support pin means 102 and 104. The toner container unit U is then rotated in the counterclockwise direction. This rotation brings the contact portions 98 and 100 of support frame means 80 into contact with the contacting portions 106 and 108 of main frames 3 and 5. The contact portions 98 and 100 are releasably fastened to the contacting portions 106 and 108 using screws which are fixing means. The bellows 66 is then coupled to the coupling pipe means 70 of developing mechanisms 4 to 10 by an attaching detaching means 114 that will be described later. Thus, the predetermined fixing position of the toner container unit U is determined. Thereafter, the engaging means 112 which constitutes a part of stop means is fixed at a predetermined position of the main frame 3.

Figure 7:
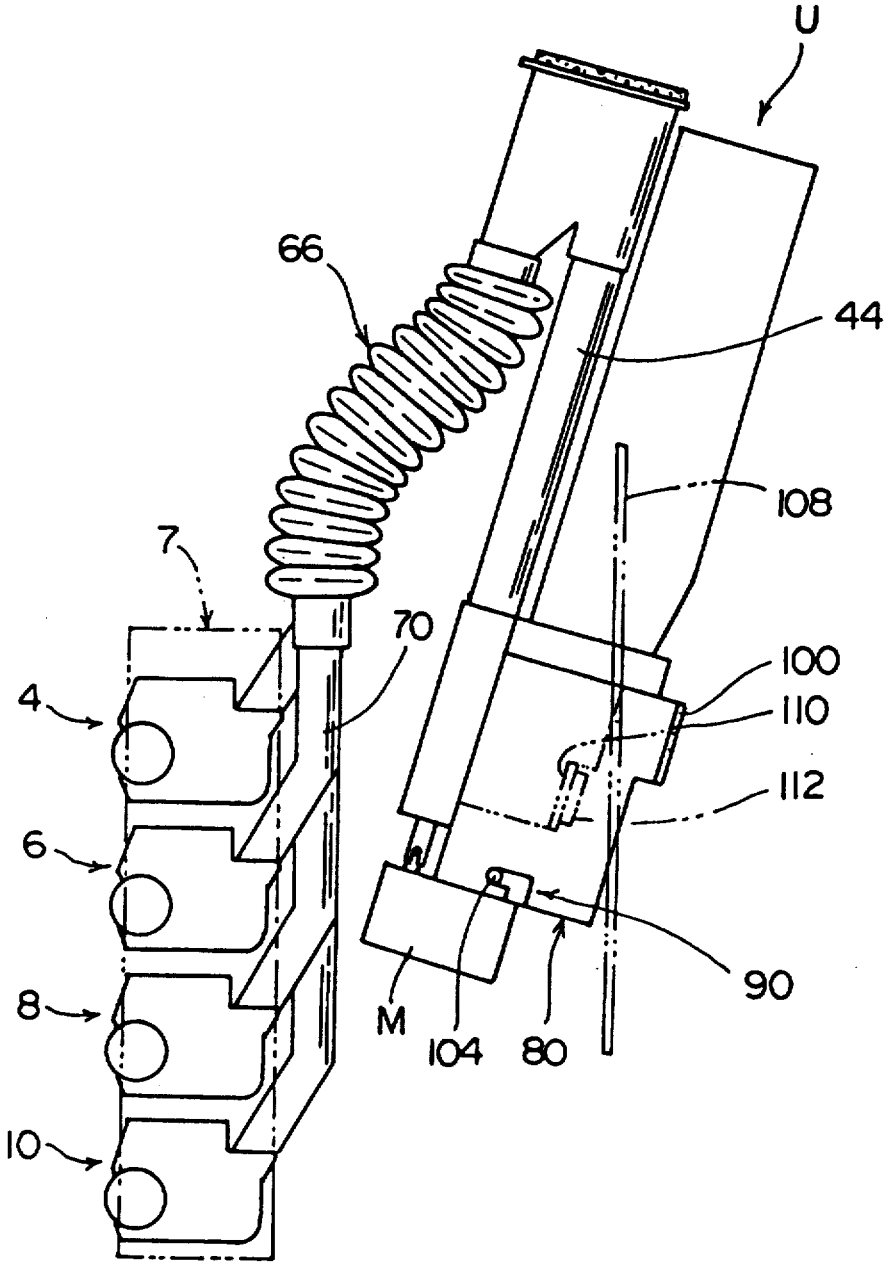
FIG. 7 is a schematic side view showing the condition where the toner container unit is located at a predetermined retracted position.

Movement of the toner container unit U from the above predetermined fixed position to the retracted position shown in FIG. 7 is effected as described below. That is, the contact portions 98 and 100 of support frame means 80 are released from the contacting portions 106 and 108 of main frames 3 and 5 by removing the screws. Then, the toner container unit U is rotated in the clockwise direction about support pin means 102 and 104 of main frames 3 and 4. As the toner container unit U is rotated by a predetermined angle, the protrusion means 110 of support frame means 80 comes into contact with the engaging means 112 of main frame 3 to prevent any further rotation. The toner container unit U is maintained under a condition in which it is tilted by a predetermined angle by its own weight. The bellows 66 are distorted rightwardly with respect to the coupling pipe means 70 as shown in FIG. 7 to absorb the rotational motion of the toner container unit U. Thus, the predetermined retracted position of the toner container unit U is determined. The bellows 66 are disconnected from the coupling pipe means 70 of developing mechanisms 4 to 10 by the attaching/detaching means 114 that will be mentioned later, and wide space is formed over the developing mechanisms 4 to 10. Thus, only the movable frame 7 that includes the developing mechanisms 4 to 10 can be pulled out upwardly along the rail means of main frames 3 and 5 independently of the toner container unit U.

It will be easily understood that movement of the toner container unit U from the above predetermined retracted position to the predetermined fixed position can be made by carrying out the above operation in the reverse order. Therefore, the operation of this movement is omitted here.

Figure 8:
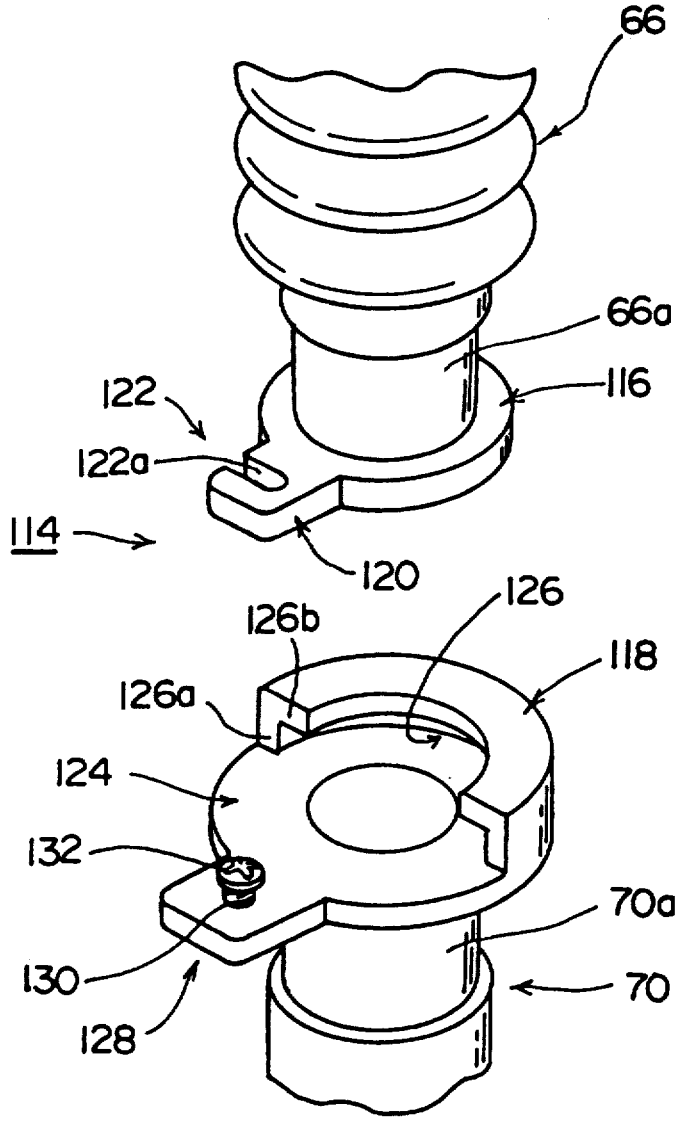
FIG. 8 is a perspective view showing the condition where an attach/detach means is detached.

Next, described below with reference to FIG. 8 are the attaching/detaching means 114 that are provided between the bellows 66 and the coupling pipe means 70 for the developing mechanisms 4 to 10. The attaching/detaching means 114 have substantially the same constitution. Therefore, the attaching/detaching means 114 provided between the bellows 66 and the coupling pipe means 70 of developing mechanism 6 will be described as example here.

The upper end of coupling pipe means 70 is coupled to the lower end of retractable means 66 via the attaching/detaching means 114, and the lower end of coupling pipe means 70 is coupled to the developing mechanism 6. The attaching/detaching means 114 includes a first flange portion 116 formed at the lower end of bellows 66 and an engaging portion 118 formed at the upper end of coupling pipe means 70.

The first flange portion 116 is formed at the lower end of a cylindrical portion 66*a* that is formed at the lower end of the retractable means 66 and protrudes by a predetermined width outwardly in the radial direction from the cylindrical portion 66*a*. The periphery of the first flange portion 116 has substantially a constant thickness and assumes a circular shape in most of the portion thereof. The upper surface protruded from the cylindrical portion 66*a* and the lower surface (not shown) are formed substantially flatly. A first protruded portion 120 is formed on the outer peripheral surface of the first flange portion 116 outwardly protruding in the radial direction. The first protruded portion 120 has a thickness which is substantially equal to that of the first flange portion 116. A through hole means 122 is formed in the first protruded portion 120. The through hole means 122 in this embodiment is constituted by a hooked groove 122*a* formed in the first flange portion 116 along the circumferential direction in a manner that one end thereof is opened and the other end thereof is closed. The through hole means 122 may simply be a through hole or an elongated hole that extends in the circumferential direction.

The engaging portion 118 is formed at the upper end of a cylindrical portion 70*a* formed at the upper end portion of coupling pipe means 70. The engaging portion 118 includes a second flange portion 124 that protrudes from the cylindrical portion 70*a* by a predetermined width outwardly in the radial direction and an engaging groove means 126 that is formed in an arcuate shape on the upper surface of the second flange portion 124. The outer periphery of the second flange portion 124 has a circular shape in most of the portions thereof, and the upper surface thereof is formed substantially flatly. The engaging groove means 126 in this embodiment is formed in a semi-arcuate shape on the upper surface of the second flange portion 124. The engaging groove means 126 permits a part (semi-arcuate portion) of the outer periphery of the first flange portion 116 to engage therewith, and covers a part of the outer periphery and a part of the upper surface of the first flange portion 116. That is, the engaging groove means 126 includes an upright portion 126*a* formed along the outer peripheral edge on the upper surface of the second flange portion 124 and a protruded portion 126*b* that extends substantially horizontally from the vertex of the upright portion 126*a* toward the inside in the radial direction. The radius of inner peripheral surface of the upright portion 126*a* is substantially the same as or is slightly greater than that of the outer peripheral surface of the first flange portion 116. Further, the clearance between the upper surface of second flange portion 124 and the protruded portion 126*b* is substantially the same as or is slightly greater than the thickness of the first flange portion 116. By selecting the materials of the first flange portion 116 and engaging portion 118, it becomes possible to set a suitable tightening margin. In this embodiment, the first flange portion 116 is made of a crystalline resin such as polypropylene, polyacetal or the like and the engaging portion 118 is made of an ABS resin.

A second protruded portion 128 is formed on the outer periphery of the second flange portion 124 at a position corresponding to the first protruded portion 120 of the first flange portion 116, the second protruded portion 128 outwardly protruding in the radial direction. The second protruded portion 128 has a thickness substantially the same as that of the second flange portion 124. An engaging hole means 130 is formed in the second protruded portion 128. The engaging hole means 130 is constituted by a threaded hole, and a tightening means 132 or, concretely, a screw 132 that is a fastening means is preliminarily engaged therewith without being completely tightly screwed. The clearance between the head of the screw 132 and the second protruded portion 128 is set to be greater than the thickness of the first protruded portion 120. The hooked groove 122*a* which is a through hole means 122 and the engaging hole means 130 must be positioned to be in match with each other in a position under the condition where the outer periphery of the first flange portion 116 is partly engaged with the engaging groove means 126. Here, the engaging hole means 130 and the tightening means 132 tightened thereto may not be limited to the above ones but may be in any other form provided a predetermined tightening force is obtained. It is, however, desired that the tightening means 132 is capable of accomplishing the tightening and untightening without being removed from the second flange portion 124.

The attaching/detaching means 114 is constituted as described above, and the bellows 66 is detachably attached to the coupling pipe means 70 as described below. That is, to mount the bellows 66 on the coupling pipe means 70, the first flange portion 116 of the bellows 66 is rotated in the circumferential direction so that the position of the first protruded portion 120 is not interfered by the screw 132 of the second protruded portion 128. Then, the first flange portion 116 is inserted in the engaging groove means 126 and is then rotated in the reverse circumferential direction. Thus, the hooked groove **122*a* of the first protruded portion 120 is brought into engagement with the screw 132. Under this condition, the screw 132 is screwed into the engaging hole means 130, so that the first protruded portion 120 is secured to the second protruded portion 128 and the attaching/detaching means 114** is mounted.

To remove the bellows 66 from the coupling pipe means 70, the screw 132 is loosened, and the first flange portion 116 is rotated in the circumferential direction in order to completely disengage the hooked groove **122*a* in the first protruded portion 120 from the screw 132. Then, the first flange portion 116 is moved in the direction of the screw 132 and is removed from the engaging groove means 126. Thus, the attaching/detaching means 114** is placed in a detached state.

Though it was described that the toner containers in this invention are provided in the same number as that of the developing mechanisms, the invention further includes the case where two toner cartridges are provided in one toner container. Specifically, in the case of the toner container containing, for example, a black toner that is used in a relatively large amount, there is provided a toner hopper (not shown) that corresponds to the container body 33 of this embodiment and it can be contrived to detachably provide two toner cartridges (not shown) on the toner hopper. In the present invention therefore, the words "toner containers of a number equal to that of the developing mechanisms" include the above-mentioned instance.

The multi-color developing device according to the present invention has the characteristic constitution as described above and makes it possible to accomplish the effects as described below.

(1) The toner container unit is constituted to be selectively located at a predetermined fixed position relative to the developing mechanism or at a predetermined retracted position turned in a direction to separate away from the developing mechanism. To carry out the maintenance operation for the developing mechanism, therefore, the toner container unit is brought to the predetermined retracted position so that the upper side of the movable frame including the developing mechanisms can be opened in a wide space. This enables the attaching/detaching means provided between the developing mechanism and the extension/contraction means in the toner fall passage means to be attached or detached very easily from the upper side. It becomes further possible to take out or mount the moving frame that includes developing mechanisms independently from the toner container unit. Therefore, the burden on the operator is remarkably lessened, and maintenance operation for the developing mechanisms can be carried out highly efficiently.

(2) The toner container unit is rotatably supported by the stationary frame and is brought from the predetermined fixed position to the predetermined retracted position by releasing the fixing means that is provided between the toner container unit and the stationary frame and by rotating the toner container unit until it is stopped by the stop means provided on the stationary frame. Due to the stop means, furthermore the toner container unit is maintained at the predetermined retracted position by its own weight. Therefore, the toner container unit is brought to the predetermined retracted position very easily. This contributes to enhance the maintenance operability for the developing mechanisms.

(3) The toner container unit is supported by the stationary frame by simply fitting support hole means of support frame means in the toner container unit to support pin means of the main frame in the stationary frame. Therefore, the toner container unit can be mounted on or removed from the stationary frame very easily.

(4) The constitution for selectively locating the toner container unit to the predetermined fixed position or the predetermined retracted position is very simple as a whole. Therefore, the device can be practically produced at a relatively low cost. Furthermore, since it can be mass-produced, it has a high practical value.

(5) The attaching/detaching means can be attached or detached between the bellows and the coupling pipe means of the developing mechanism by simply tightening or untightening it without the need of rotating the bellows or without the need of removing the fastening means that is provided for the attaching/detaching means. Therefore, the attaching/detaching operation can be carried out very easily, quickly, and very efficiently. Moreover, there is no probability of losing the fastening means and the operation efficiency can be improved.

In addition to the above-mentioned effects, the multi-color developing device of the invention possesses the effects described in the specification of Japanese Patent Application No. 321401/1990 that was filed by the present applicant. The above effects, however, are not described here.

Described below is another characteristic constitution included in the above-mentioned multi-color developing device 2. The developing mechanisms 4 to 10 are supported by the movable frame 7 to move over a predetermined range in the direction to approach or separate away from the rotary drum 25, and are urged toward the direction to approach the rotary drum 25. The above constitution will be described in detail with reference chiefly to FIGS. 9 to 16, wherein the same portions as those of FIGS. 1 to 8 are denoted by the same reference numerals.

The developing mechanisms 4, 6, 8 and 10 are supported by the movable frame 7 to rotate over a predetermined range in the direction to approach and separate away from the rotary drum 25. The movable frame 7 is equipped with urging means for each of the developing mechanisms 4, 6, 8 and 10 to urge them toward the direction to approach the rotary drum 25. Constitutions of these developing mechanisms (and of developing housings), constitutions for supporting the developing mechanisms by the movable frame 7, and constitutions of the urging means arranged for the developing mechanisms, are substantially the same. Therefore, described below are the constitutions related to the developing mechanisms 10 only among them, as example.

Figure 12:
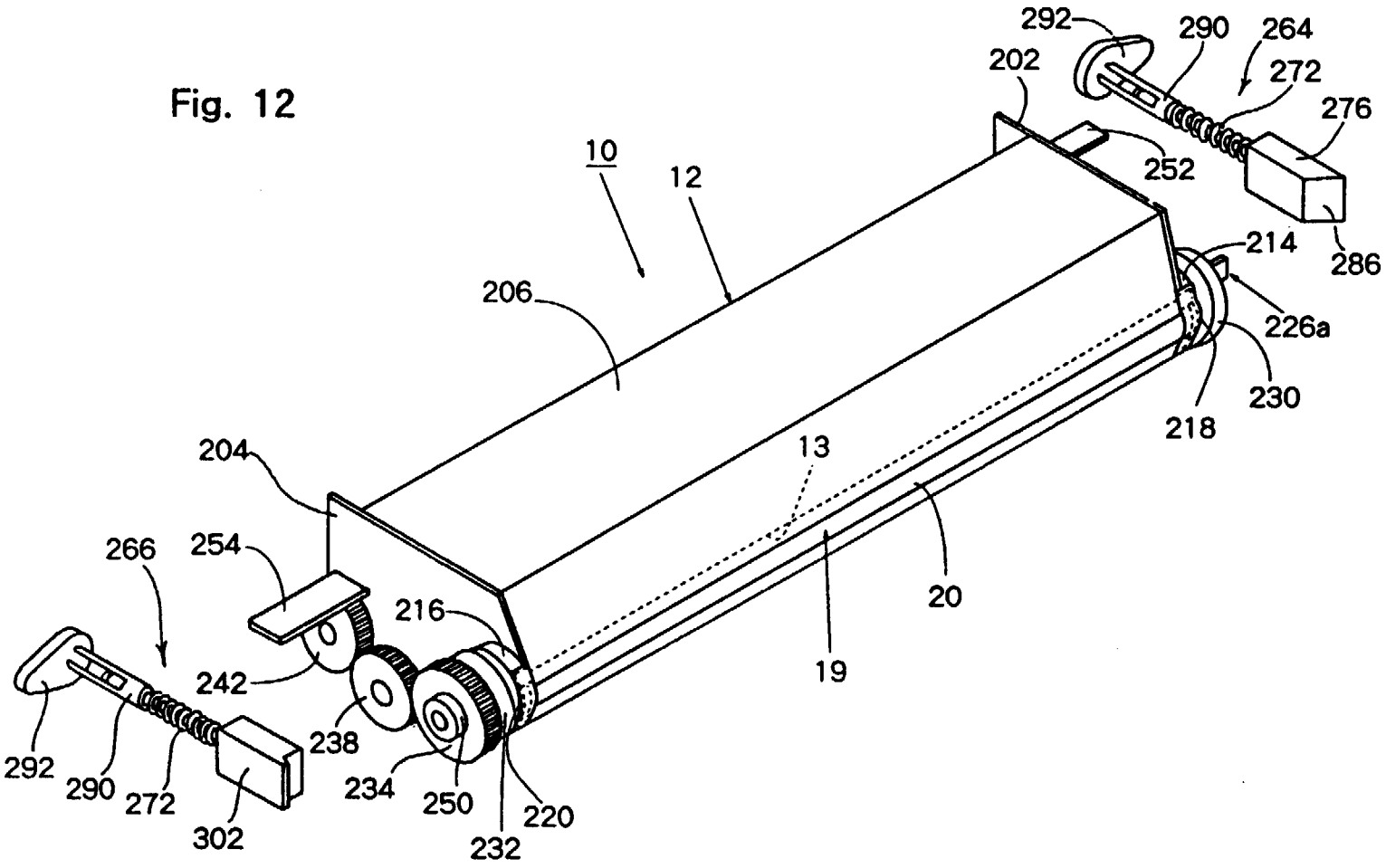
FIG. 12 is a schematic perspective view showing one of the developing mechanisms and the urging means therefor shown in FIG. 9.
Figure 13:
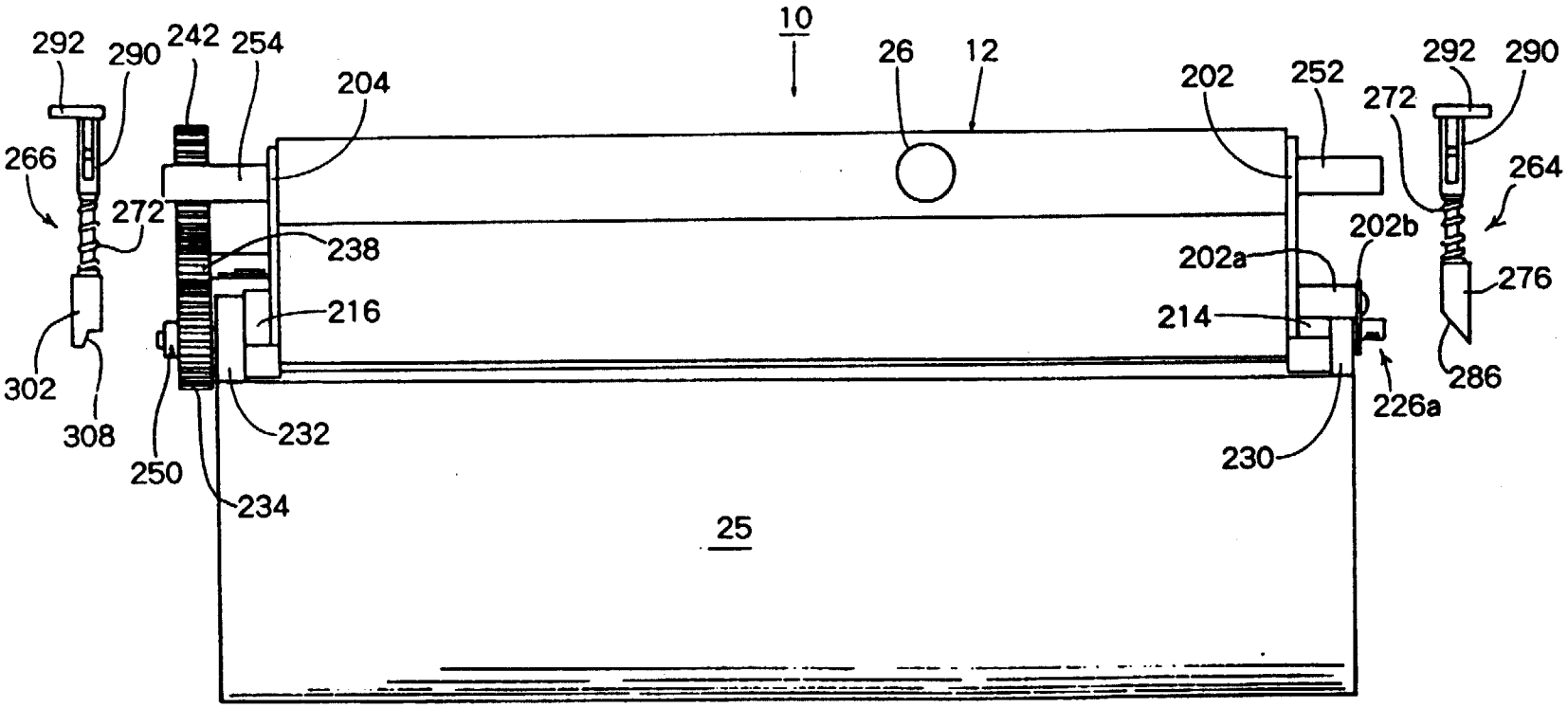
FIG. 13 is a top view illustrating the condition where the developing mechanism is located at a developing position.
Figure 14:
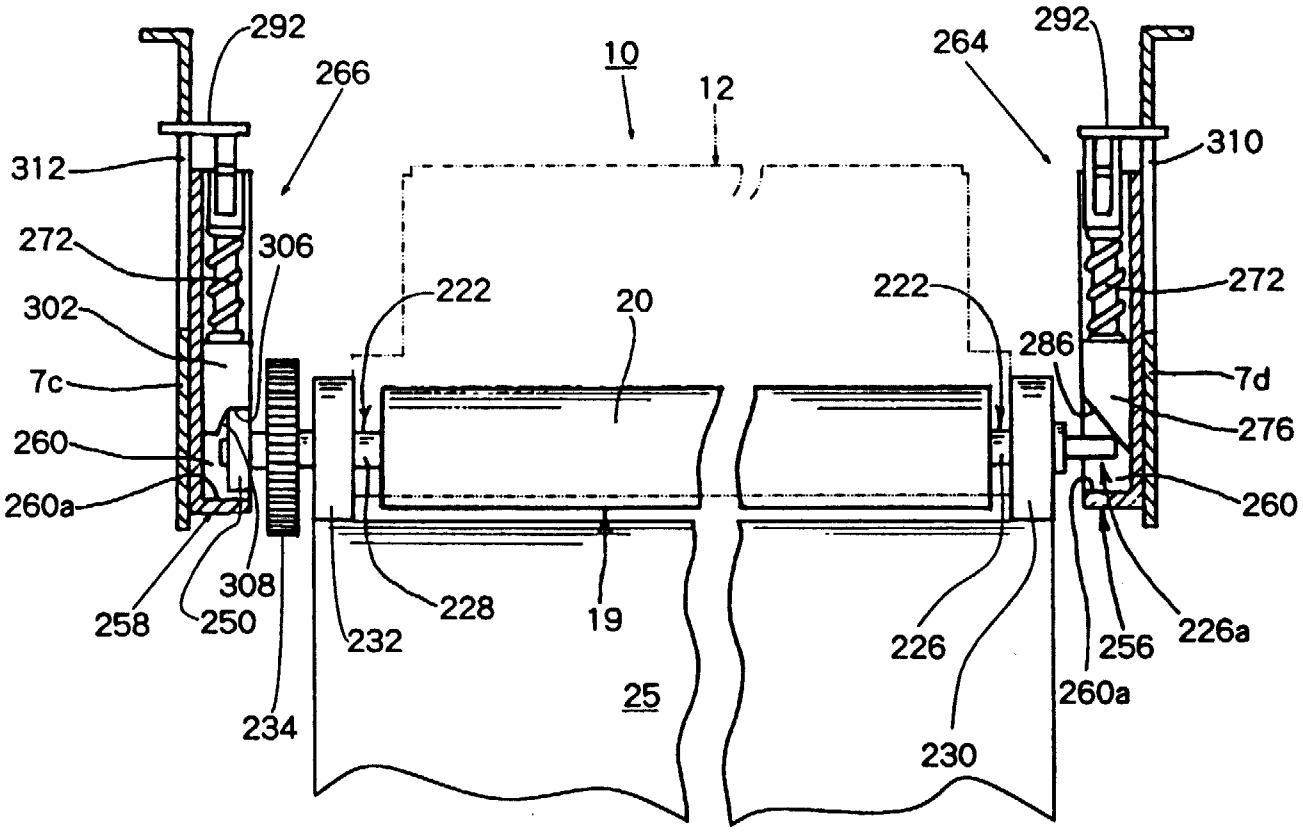
FIG. 14 is a top view, partly broken, showing relationships in position of a support shaft means of developing agent application means, an urging means and a rotary drum.

Referring to FIGS. 12 to 14 the developing mechanism 10 includes the developing housing 12 and is formed as a unitary structure together with the developing housing 12. The developing housing 12 as a whole has an elongated box-like shape and is made of a synthetic resin. By making reference further to FIG. 18, the developing housing 12 includes a bottom wall 200, side walls 202 and 204, a top wall 206 an upper portion 208 of front wall a lower end portion 210 of front wall, and a rear wall 212. The opening 13 is formed in the front surface of the developing housing 12 and extends elongatedly in the direction of width. The upper portion 208 of front wall arranged over the opening 13 is slightly tilted forwardly toward the lower direction and the lower end portion 210 of front wall arranged under the opening 13 is slightly tilted forwardly toward the upper direction. As will be understood from FIGS. 12 and 17, protruded wall portions 214 and 216 of nearly a semicircular shape are formed at front portions of both side walls 202 and 204 of the developing housing 12, and are outwardly protruded in the direction of width. Front edges 218 and 220 of the protruded walls 214 and 216 have an arcuate shape of a predetermined radius.

In the front portion of the developing housing 12 is mounted the developing agent application means via support shaft means 222. The developing agent application means in this embodiment is constituted by a magnetic brush mechanism 19. The magnetic brush mechanism 19 which per se may be of a known form is constituted by a rotary sleeve member 20 of a cylindrical shape and a static magnet member 21 disposed in the sleeve member 20. A rotary shaft 228 that outwardly protrudes in the axial direction is secured to an end plate arranged at an end of the sleeve member 20. The rotary shaft 228 is rotatably supported by the protruded wall portion 216 in the side wall 204 of the developing housing 12. An end plate arranged at the other end of the sleeve member 20 is rotatably supported by a fixed shaft 226 of the magnet member 21. The rotary shaft 228 protrudes through the protruded wall portion 216, and a distance setting roller 232 is rotatably fitted to the protruded portion thereof. An input gear 234 is further fitted thereto. An end of the fixed shaft 226 of magnet member 21 is rotatably supported by the end plate disposed at one end of the sleeve member 20, and the other end of the fixed shaft 226 is supported by the protruded wall portion 214 of side wall 202 of developing housing 12 without being allowed to rotate. The other end of the fixed shaft 226 protrudes through the protruded wall portion 214, and a distance setting roller 230 is rotatably fitted to the protruded portion thereof. The support shaft means 222 is constituted by the rotary shaft 228 and fixed shaft 226.

Figure 18:
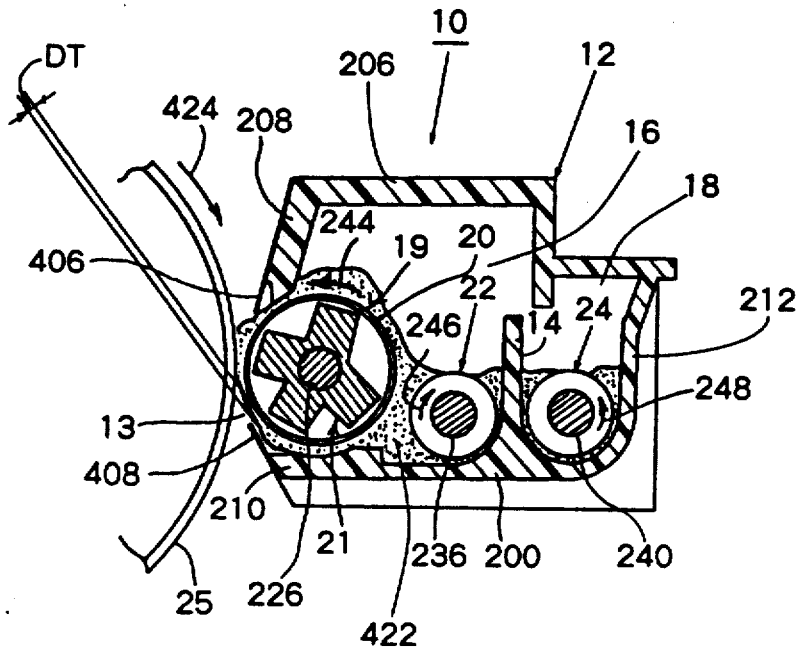
FIG. 18 is a sectional view along the line C—C of FIG. 17.

The partitioning wall 14 mentioned earlier with reference to FIG. 2 is formed upwardly protruding from the bottom wall 200 of developing housing 2 as shown in FIG. 18. Both ends of the partitioning wall 14 are positioned maintaining a gap relative to the inner surfaces of side walls 202 and 204. A rotary shaft 236 of the spiral roller 22 arranged in the chamber 16 is rotatably supported by both side walls 202 and 204. One end of the rotary shaft 236 protrudes through the side wall 204 and has an input gear 238 that is fitted to the protruded end thereof. A rotary shaft 240 of the spiral roller 24 arranged in the chamber 18 is rotatably supported by the side walls 202 and 204. One end of the rotary shaft 240 protrudes through the side wall 204 and has an input gear 242 fitted to the protruded end thereof. The input gear 242 engages with the above input gear 238. The input gear 234 engages with the input gear 238 of the spiral roller 22. Under the condition where the developing mechanism 10 is mounted on the movable frame 7, the gear 234 is connected to a rotational drive source (not shown) which may be an electric motor via a suitable transmission gear (not shown). The sleeve member 20 of the magnetic brush mechanism 19 is rotated by the rotational drive source in a direction indicated by arrow 244 in FIGS. 18, and the spiral rollers 22 and 24 which are the first and second stirrer mechanisms are rotated in the directions indicated by arrows 246 and 248 in FIG. 18, respectively. The stationary magnet member 21 is fitted onto the fixed shaft 226. The magnet member 21 made of a permanent magnet has four leg portions that protrude in the radial direction, and has magnetic poles at the ends of the leg portions.

The peripheral surface of the sleeve member 20 is partly exposed through the port 13 of the developing housing 12. Referring to FIGS. 12 and 14 again, a notchconsisting of two parallel surfaces is formed in a protruded end portion 226*a* of the fixed shaft 226 (see also FIG. 9). As shown in FIG. 13, a boss 202*a* is provided on the side wall 202 of developing housing 12. An engaging plate 202*b* is fastened to the boss 202*a*, and the notch in the end portion 226*a* of the fixed shaft 226 is brought into engagement with the engaging hole formed in the other end of the engaging plate 202*b*. Thus, the fixed shaft 226 is locked from rotating. The gear 234 and a bearing 250 are rotatably fitted to the protruded end portion of the rotary shaft 228.

On both sides of the developing housing 12 are provided support protrusion means 252 and 254 so as to protrude outwardly. That is, the side wall 202 has the support protrusion means 252 formed as a unitary structure, and the side wall 204, the support protrusion means 254 formed as a unitary structure. The support protrusion means 252 and 254 are constituted by a plate member of substantially a rectangular shape and are of the same shape.

The thus constituted developing mechanism 10 is supported by the movable frame 7 to move over a predetermined range in the direction to approach or separate away from the rotary drum 25. The movable frame 7 is provided with the urging means which urges the developing mechanism 10 in the direction to approach the rotary drum 25. The above constitution will now be described.

Referring to FIGS. 9 to 11 and 14, the distance between the side plates 7*d* and 7*c* of the movable frame 7 is broader than the width of the developing mechanism 10 in the lengthwise direction. That is, when the developing mechanism 10 is placed in position, the side plates 7*d* and 7*c* are located on the outsides of both sides of the developing mechanism 10 i.e., located on the outsides of both sides of the developing housing 12 at a predetermined distance. In the inner surface of the side plates 7*d* and 7*c* are formed guide groove means 256 and 258 extending in the direction in which the developing mechanism 10 moves to approach or separate away from the rotary drum 25. The guide groove means 256 and 258 have substantially the same shape and are made of a synthetic resin as a unitary structure. The guide groove means 256 is fastened to the side plate 7*d*, and the guide groove means 258 is fastened to the side plates 7*c* using fastening means such as screws. The guide groove means 256 and 258 have ends which are closed on the side close to the rotary drum 25, have ends which are open on the side separated away from the rotary drum 25, and further have ends which are open on the inner side faced to each other.

The guide groove means 256 and 258 will further be described specifically. Each of the guide groove means 256 and 258 includes a first guide groove 260 extending in the direction in which the developing mechanism 10 moves to approach or separate away from the rotary drum 25, and a second guide groove 262 extending in the same direction in parallel with the first guide groove 260. The width and length of the first guide groove 260 are greater than those of the second guide groove 262. The first guide groove 260 and the second guide 262 have ends which are closed on the side close to the rotary drum 25, and ends which are open on the side separated away from the rotary drum 25 and on the inner side opposed to each other. The closed ends of the first guide groove 260 and of the second guide groove 262 are denoted by reference numerals 260*a* and 262*a*. The second guide groove 262 is located over the first guide groove 260 at an end position separated away from the rotary drum 25.

Both ends of the support shaft means 222 of developing agent application means. i.e., the end 226*a*, in which the notch is formed, of the fixed shaft 226 and the bearing 250 of rotary shaft 228 are respectively engaged in the first guide grooves 260 to move in the above-mentioned direction. The support protrusion means 252 and 254 of the developing housing 12 are engaged in the second guide groove 262 to move in the above-mentioned direction. Each of the second guide grooves 262 is constituted by a groove of a substantially rectangular shape in which can be movably engaged the support protrusion means 252 and 254 that consist of plate members. As described above, the developing mechanism 10 is supported by the movable frame 7 to move along the guide groove means 256 and 258 in the direction to approach or separate away from the rotary drum 25.

Figure 10:
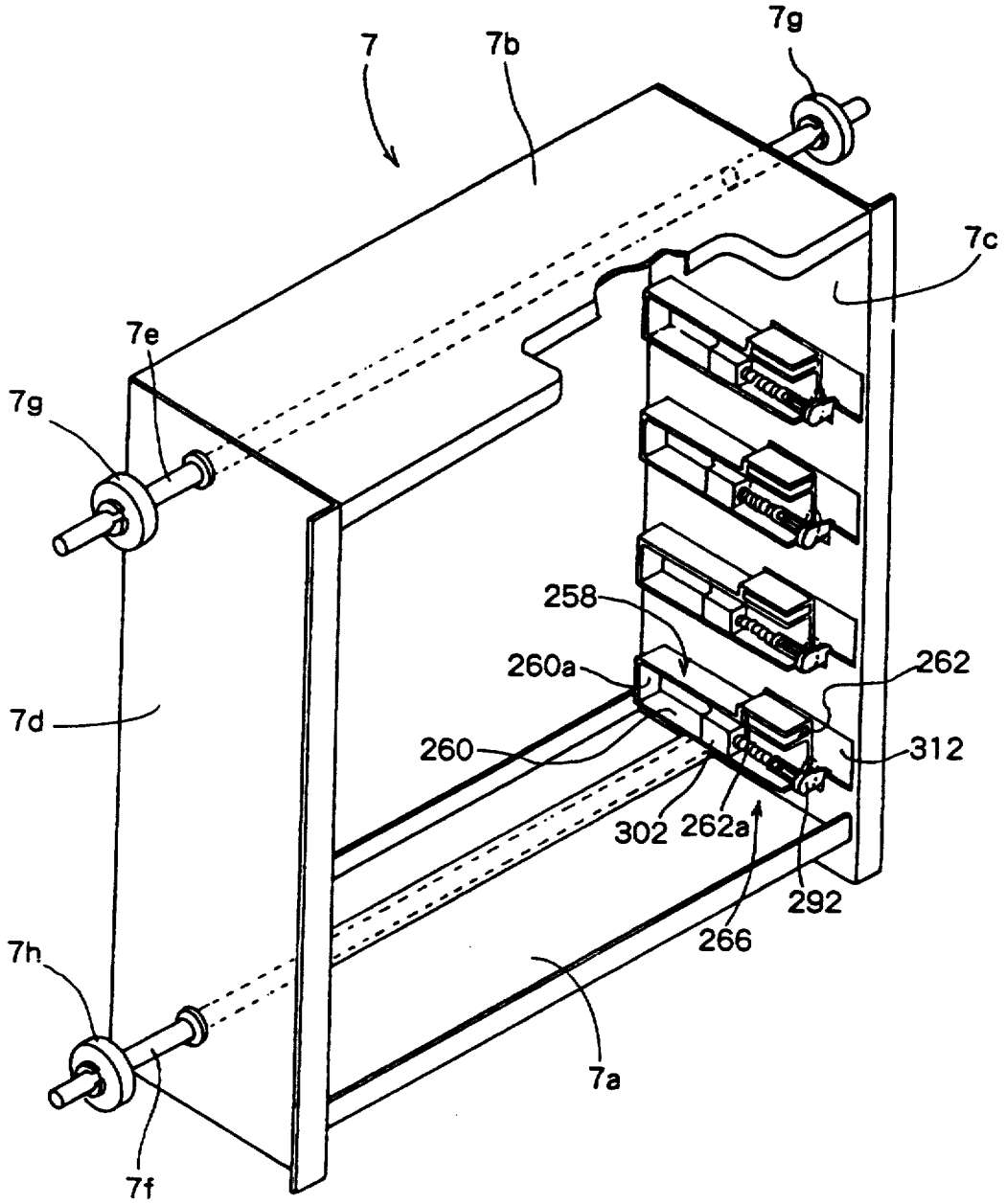
FIG. 10 is a perspective view which schematically illustrates major portions of the movable frame of FIG. 9.
Figure 11:
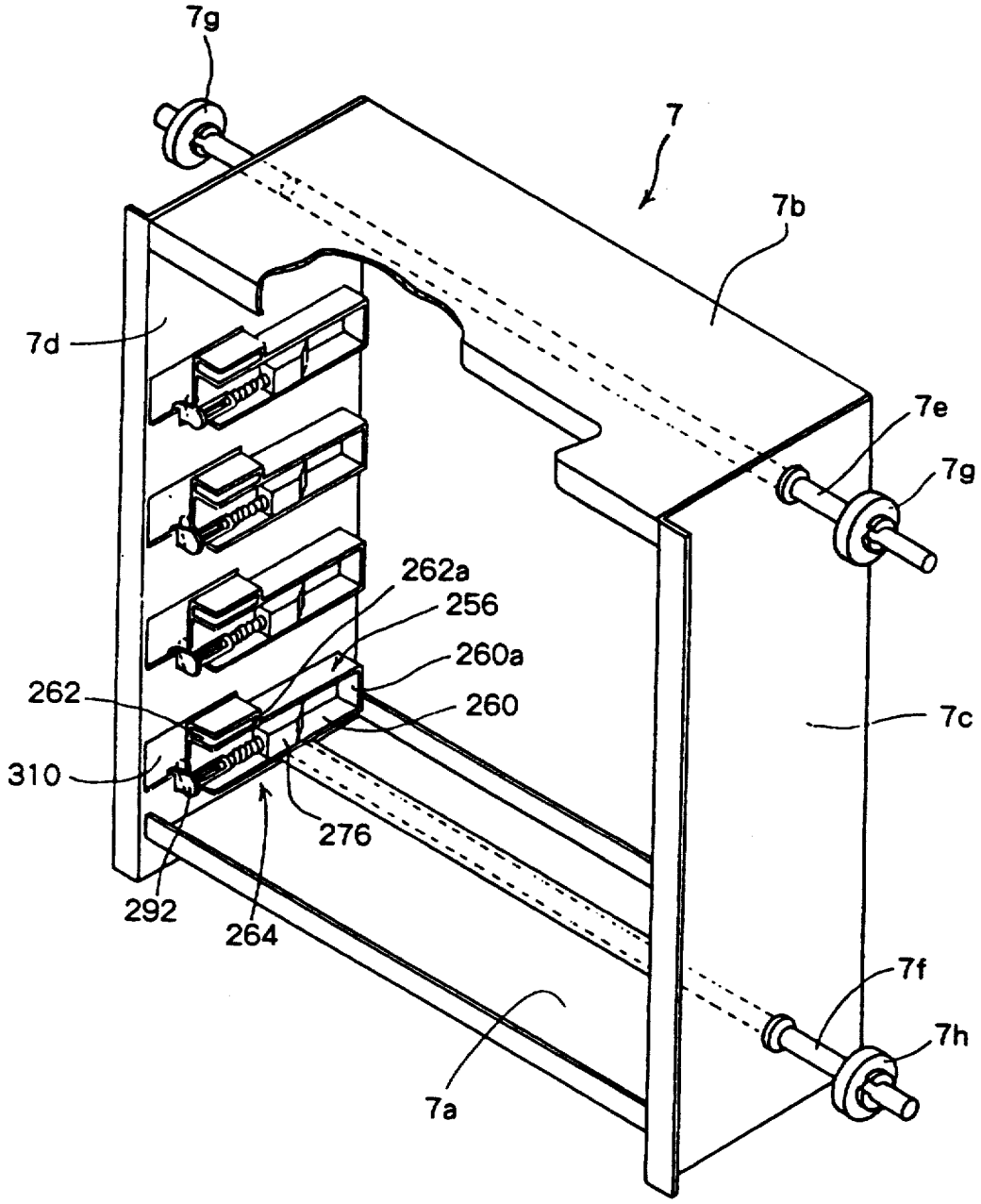
FIG. 11 is a perspective view of when the movable frame shown in FIG. 10 is viewed from another direction.

As shown in FIGS. 10 11 and 14, the urging means which urge the developing mechanism 10 in the direction to approach the rotary drum 25 in this embodiment are disposed in the guide groove means along therewith. That is, one urging means 264 is disposed in the guide groove means 256 and the other urging means 266 is disposed in the guide groove means 258.

Figure 15:
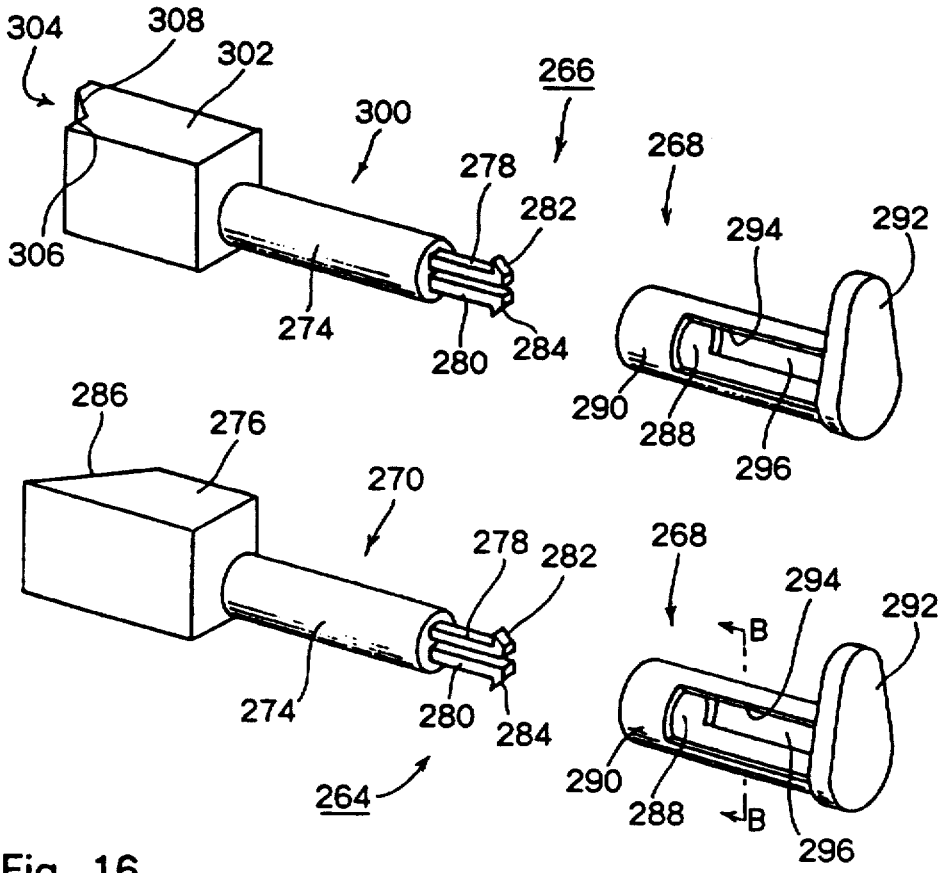
FIG. 15 is a perspective view which shows the urging means in a disassembled manner but without showing the compression coiled spring.
Figure 16:
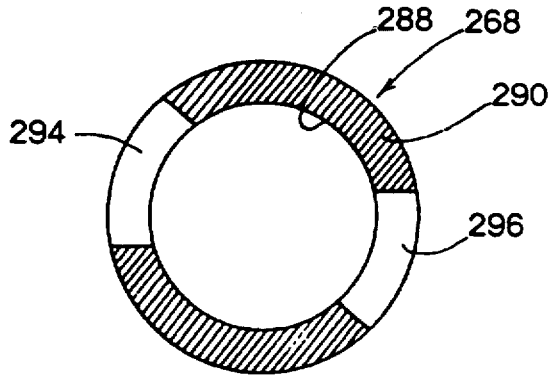
FIG. 16 is a sectional view along the line B—B of FIG. 15.

The urging means 264 will, first, be described with reference to FIGS. 15 and 16. The urging means 264 is disposed in the guide groove means 256, and is constituted by a position restriction means 268 which restricts the position in the direction to separate away from the rotary drum 25, a pushing means 270 detachably engaged with the position restriction means 268 and a compression coil spring 272 (see FIG. 14) provided between the pushing means 270 and the position restriction means 268. The position restriction means 268 and the pushing means 270 are made of a synthetic resin, respectively.

The pushing means 270 includes a pole-like main body 274, a pushing portion 276 formed at an end of the main body 274, and a pair of engaging projections 278 and 280 that protrude in the axial direction from the other end of the main body 274 and are arranged at a predetermined gap. Engaging pawls 282 and 284 are formed at the tips of the pair of engaging projections 278 and 280. The engaging pawls 282 and 284 have a size in the radial direction which is so determined that the engaging pawls 282 and 284 engaged with a pair of engaging grooves 294 and 296 that will be mentioned later will not escape from the engaging grooves 294 and 296. The engaging pawls 282 and 284 include a tilted portion and a stepped portion. The pair of engaging projections 278 and 280 are capable of being bent in the directions in which the engaging pawls 282 and 284 approach each other. The pushing portion 276 is constituted by a block of substantially a rectangular parallelopiped shape, and has a tilted surface 286 formed at the end thereof.

The position restriction means 268 includes a cylindrical portion 290 having a fitting hole 288 in which the main body 274 is fitted to move relative thereto, and an engaging lever 292 provided at an end of the cylindrical portion 290 at right angle thereto. In the cylindrical portion 290 are formed a pair of engaging grooves 294 and 296 which extend in the axial direction with a predetermined width and of which both ends are closed. As shown in FIG. 16, the engaging grooves 294 and 296 are formed in the cylindrical portion 290 at symmetrical opposite positions at an angle of 180 degrees. With the engaging pawls 282 and 284 being engaged with the engaging grooves 294 and 296, the pushing means 270 is engaged with the position restriction means 268 to move in the axial direction over a predetermined range under the condition where part of the main body 274 is fitted to the fitting hole 288 of the cylindrical portion 290. Tilted portions of the engaging pawls 282 and 284 facilitate the engagement with the engaging grooves 294 and 296, and stepped portions thereof come in contact with the ends of the engaging grooves 294 and 296 in the axial direction to prevent the pushing means 270 from escaping. The compression coiled spring 272 is disposed about the outer periphery of the main body 274 in a manner that one end thereof comes in contact with an end of the pushing portion 276 and the other end thereof comes in contact with the other end of the cylindrical portion 290. The engaging grooves 294 and 296 have a width in the radial direction which is so determined that the position restriction means 268 is allowed to rotate by a predetermined angle with respect to the pushing means 270 under the condition where the pushing means 270 is engaged with the position restriction means 268. That is, the width of engaging pawls 282 and 284 and the width in the circumferential direction of engaging grooves 294 and 296 are so determined that the engaging grooves 294 and 296 permits the engaging pawls 282 and 284 to turn by a predetermined angle under the condition where the engaging pawls 282 and 284 are engaged with the engaging grooves 294 and 296.

On the other hand, the urging means 266 is disposed in the guide groove means 258. The urging means 266 is substantially quite the same as the urging means 264 except the constitution of pushing portion 302 in the pushing means 300. Here, therefore, the constitution of the pushing portion 302 only is described and the other same portions are denoted by the same reference numerals. The pushing portion 302 is constituted by a block of substantially a rectangular parallelopiped shape and has a stepped portion 304 formed at an end thereof. The stepped portion 304 includes a surface 306 intersected at right angles to the axial direction and a tilted surface 308 that rises at a predetermined angle with respect to the surface 306.

As shown in FIGS. 10, 11 and 14, engaging 310 and 312 are formed in the side plates *7d* and *7c* of the movable frame 7 in relation to the position restriction means 268.

Referring to FIG. 14, the end 226*a* of fixed shaft 226 of the developing mechanism 10 is movably supported by the first guide groove 260 in the guide groove means 256, and the bearing 250 of the rotary shaft 228 is movably supported by the first guide groove 260 in the guide groove means 258. Furthermore, though not shown in FIG. 14, the support protrusion means 252 of developing housing 12 is movably supported by the second guide groove 262 in the guide groove means 256, and the support protrusion means 254 is movably supported by the second guide groove 262 in the guide groove means 258. Thus, the developing mechanism 10 is supported by the movable frame 7 to freely move along the guide groove means 256 and 258 in the direction to approach or separate away from the rotary drum 25.

Under this condition, the urging means 264 is disposed in the first guide groove 260 of guide groove means 256 and the urging means 266 is disposed in the first guide groove 260 of guide groove means 258. The engaging levers 292 of urging means 264 and 266 are rotated, and are brought into engagement with engaging holes 310 and 312 of side plates *7d* and *7c* of the movable frame 7. The tilted surface 286 of pushing portion 276 of urging means 264 comes in contact with the end 226*a* (or exactly, a corner portion) of the fixed shaft 226, and urges the end 226*a* toward a direction to approach the rotary drum 25 by action of the compression coiled spring 272. At the same time, the tilted surface 286 imparts a thrust force in the axial direction from one support shaft means 222 to the other support shaft means 222. The surface 306 of pushing portion 302 of urging means 266 comes in contact with the peripheral surface of the bearing 250 of rotary shaft 228, and the tilted surface 308 comes in contact with the corner of the bearing 250 and urges the bearing 250 toward the direction to approach the rotary drum 25 by the action of the compression coiled spring 272. The tilted surface 308 receives the thrust force from the tilted surface 286. In this case, both ends of the support shaft means 222 are in contact with the tilted surface 308 and the tilted surface 286, and their thrust forces are permitted to act upon each other.

When the stepped portion 304 of pushing portion 302 of urging means 266 is formed by two surfaces that intersect at right angles, one of the two right-angled surfaces receives the thrust force from the tilted surface 286 of pushing portion 276. When a surface in parallel with the axis of support shaft means 222 is formed at the end of pushing portion 302 instead of the stepped portion 304 in the pushing portion 302 of urging means 266, the pushing portion 302 simply pushes the peripheral surface of the bearing 250 toward the direction to approach the rotary drum 25 and does not receive the thrust force from the tilted surface 286 of the pushing portion 276. In this case, the end of support shaft means 222, e.g., side surface of the bearing 250 should desirably be brought into direct contact with the inner surface of the first guide groove 260 so as to receive the thrust force from the tilted surface 286.

Figure 9:
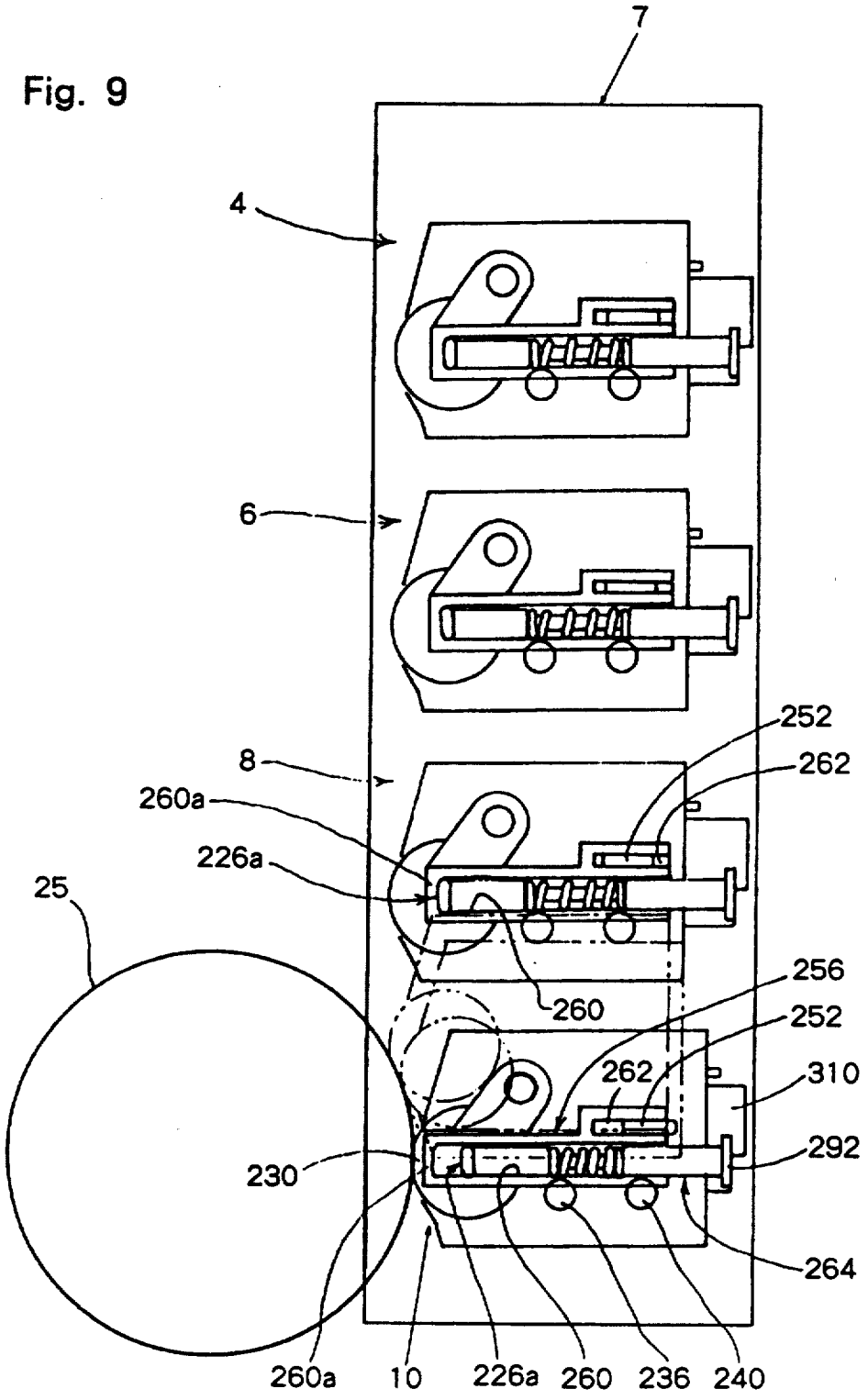
FIG. 9 is a side view which schematically illustrates the developing mechanisms supported by the movable frame and urging means therefor.

Under the condition where the developing mechanism 10 is not located at the developing position and the distance setting rollers 230 and 232 are not brought into contact with the surface of the rotary drum 25, the end 226*a* of the fixed shaft 226 and the peripheral surface of the bearing 250 of rotary shaft 228 are pushed to the closed end 260*a* of the first guide groove 260. FIG. 9 shows the condition where the ends 226*a* of fixed shafts 226 of other developing mechanisms 4 to 8 are pushed to the closed ends 260*a*. The engaging levers 292 of urging means 264 and 266 are pushed to the ends of engaging holes 310 and 312 by the compression coiled springs 272. Thus, the positions of the position restriction means 268 are determined in the direction to separate away from the rotary drum 25.

The developing mechanism 10 is supported by the movable frame 7 as described above, and other developing mechanisms 4, 6 and 8 are also similarly supported by the movable frame 7.

Referring to FIG. 9, the movable frame 7 is moved in the predetermined direction by the moving means, and the developing mechanisms 4, 6, 8 and 10 are selectively brought to the predetermined developing position to carry out the developing operation in individually different color. When the developing mechanism 10 is located at the predetermined developing position, for instance, the pair of distance setting rollers 230 and 232 arranged for the developing mechanism 10 are brought into contact with the surface of the rotary drum 25, and the developing mechanism 10 is moved in the direction to separate away from the rotary drum 25 against the urging action of urging means 264 and 266 disposed for the developing mechanism 10. Thus, the developing mechanism 10 is selectively located at the predetermined developing position. FIGS. 13 and 14, too, illustrate this condition. The urging means 264 and 266 urge both ends of support shaft means 222 of the magnetic brush mechanism 19 which is the developing agent application means, and hence, the developing housing 12 is not substantially affected by the pushing force. The above-mentioned operation is similarly carried out even for other developing mechanisms 4, 6 and 8.

It can be easily comprehended that the above-mentioned means for supporting and urging the movable frame of the developing mechanism can similarly be adapted even to a monochromatic developing device. In the case where the above means included in the present invention is applied to the monochromatic developing device, the movable frame 7 is constituted by a frame that is secured in the stationary frame. One developing mechanism is supported by the frame via the aforementioned guide groove means 256 and 258, and is urged by urging means 264 and 266 via support shaft means 222 of developing agent application means toward the direction to approach the rotary drum 25. The pair of distance setting rollers 230 and 232 are brought into contact with the surface of the rotary drum 25 by the urging action of the urging means 264 and 266, and the developing mechanism is located at the predetermined developing position with respect to the rotary drum 25. That is, the developing mechanism 10 does not move in the up-and-down direction and remains under the condition in which it is set to the developing position in FIG. 9. Other points are the same as those described with reference to the multi-color developing device of the above embodiment, and are not mentioned here again.

In either the monochromatic or multi-color developing mechanism, the pair of distance setting rollers are brought into contact with the surface of the rotary drum by the urging action of urging means when the developing mechanism is located at the predetermined developing position. In this case, the pair of distance setting rollers may be brought into direct contact with the surface of the rotary drum or may be brought into contact with the flange portions provided at both ends of the rotary drum, which are both encompassed by the present invention.

The above-mentioned multi-color developing device of the present invention further includes the above-mentioned other characteristic constitutions, and is capable of achieving the following effects. The following effects can similarly be accomplished even by the monochromatic developing device as a matter of course.

(1) The urging means is so constituted as to urge the developing mechanism toward the direction to approach the rotary drum via support shaft means which is a rigid body of the developing agent application means, and the developing housing does not undergo distortion by the pressing force of the urging means. Therefore, the developing mechanism is reliably pushed and is located at the predetermined developing position very precisely.

(2) Since the developing housing is not distorted by the pressing force of the urging means, the gap does not change but is precisely maintained as desired between the surface of the sleeve and the blade member provided in the developing housing. It is therefore made possible to uniformly maintain the thickness of the layer of the developing agent on the surface of the rotary sleeve at all time.

(3) When the urging means are disposed on both sides of the developing mechanism to urge both ends of the support shaft means, there is no probability that the developing housing is moved in the thrust direction with respect to the support shaft of the developing agent application means. Therefore, even when the constituent members are formed out of sizes to some extent within tolerable ranges, the developing mechanism can be located at the predetermined developing position without error.

(4) When at least either one of the pushing means comes in contact with one end of the support shaft means to impart the thrust force in the axial direction from one of the support shaft to the other shaft, it is possible to effectively prevent the backlash in the direction of thrust. Furthermore, when the other pushing means comes in contact with the other end of the support shaft means to receive the thrust force, the above effect can be further improved with a simple constitution.

(5) The above-mentioned effects as a whole make it possible to stably carry out the developing operation and, hence, to guarantee stable image. Moreover, durability of the whole apparatus is improved, life is lengthened, and reliability is ensured.

(6) When each of the urging means is constituted by position restriction means which restricts the position in the direction to separate away from the rotary drum, pushing means detachably engaged with the position restriction means, and compression coiled spring provided between the pushing means and the position restriction means, the entire structure is realized in the form of a compact unit. In consequence, the device has excellent attaching and detaching performance, and its assembling operation is improved.

(7) The device as a whole is constituted relatively simply and in a compact size, offering very practicable values.

Figure 17:
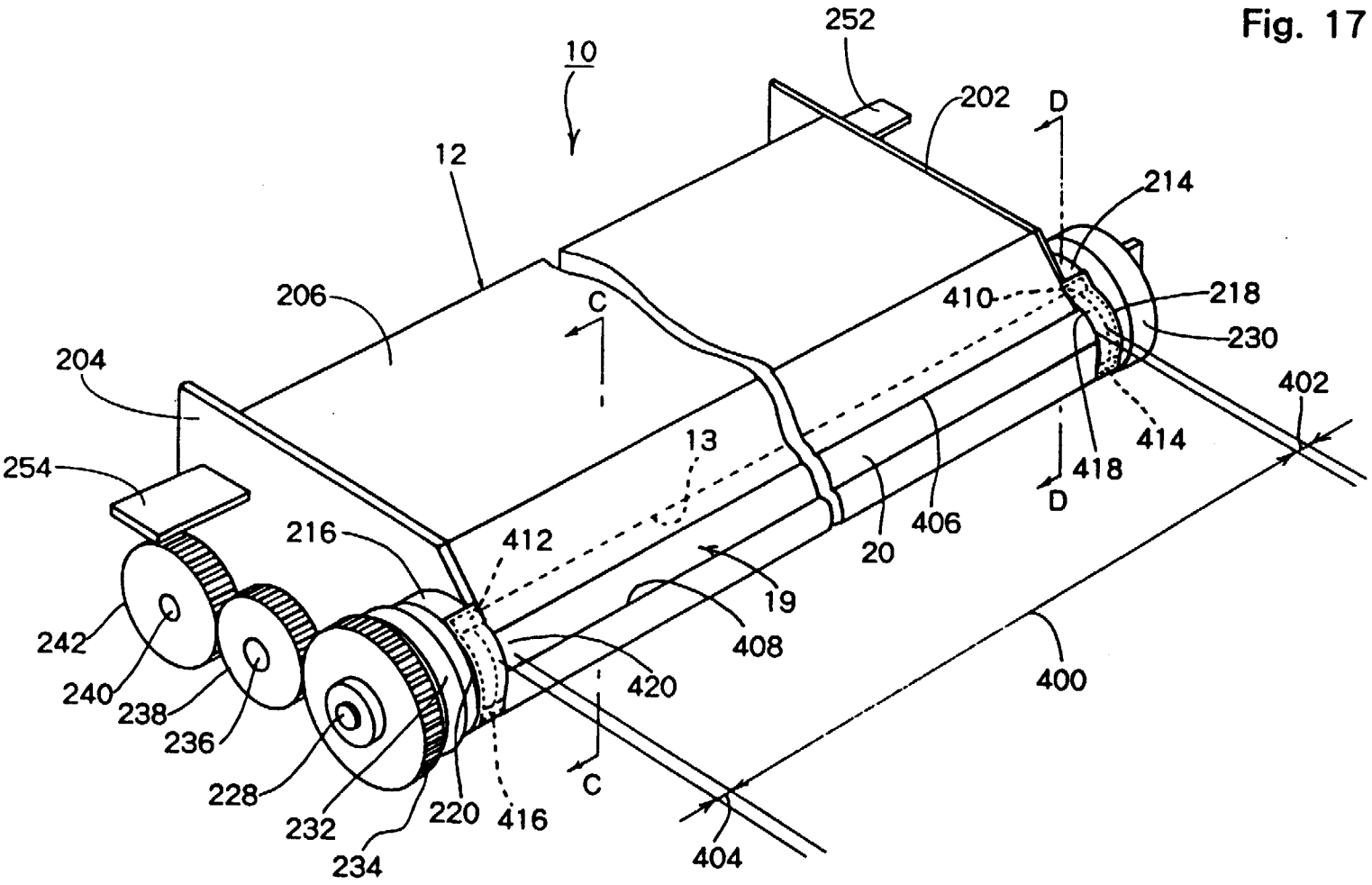
FIG. 17 is a schematic perspective view showing the developing mechanism of FIG. 12 on a slightly enlarged scale.
Figure 19:
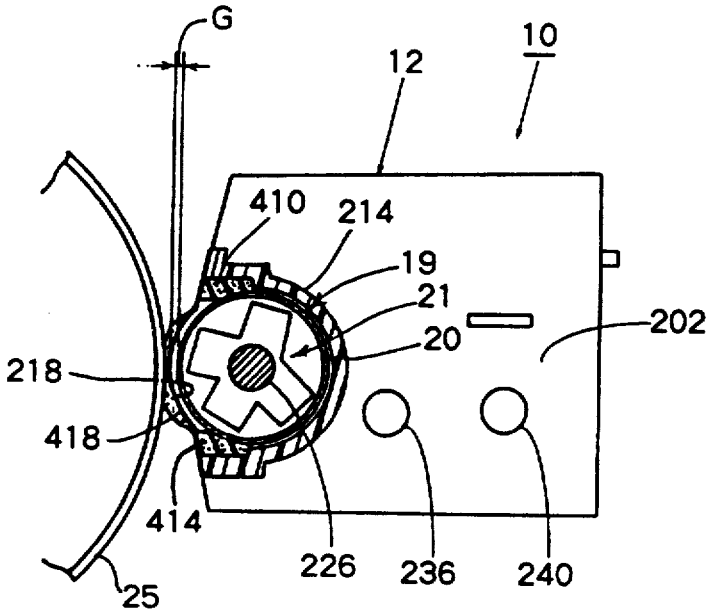
FIG. 19 is a sectional view along the line D—D of FIG. 17.

A further characteristic constitution included in the above multi-color developing device 2 will now be described with reference to FIGS. 17 to 19. This characteristic constitution is included in the developing mechanisms 4 to 10. Each developing mechanism has substantially the same constitution and, hence, only the developing mechanism 10 will be described as the example. In FIGS. 17 to 19, the same portions as those of FIGS. 1 to 18 are denoted by the same reference numerals. In the developing mechanism 10, the peripheral surface of sleeve member 20 of magnetic brush mechanism 19 which is the developing agent application means is partly exposed through the opening 13 of the developing housing 12. The sleeve member 20 extends near to the inner surfaces of the protruded wall portions 214 and 216 beyond the main portions of both side walls 202 and 204 of the developing housing 12. The magnet member 21 has a length in the axial direction which is shorter than the length of the sleeve member 20 in the axial direction, and both ends of the magnet member 21 are positioned on the inside of both ends of the sleeve member 20 in the axial direction or, in the illustrated embodiment, are positioned substantially in agreement with the inner surfaces of main portions of both side walls 202 and 204 of the developing housing 12. The end plates exist at both ends of the sleeve member 20, and it is not allowed to extend the magnet member 21 up to the ends of the sleeve member 20. As clearly shown in FIG. 17, therefore, the peripheral surface of the sleeve member 20 includes a central developing operation region 400 on the inside of which the magnet member 21 exists to establish a considerable degree of magnetic field (i.e., magnetic attractive force), and non-developing operation regions 402 and 404 on both sides inside of which the magnetic member 21 does not exist and very small magnetic field (i.e., magnetic attractive force) is established. In the illustrated embodiment, the central developing operation region 400 exists between the inner surfaces of both side walls 202 and 204 of the developing housing 12, and the non-developing operation regions 402 and 404 of both sides exist on the outsides of inner surfaces of both side walls 202 and 204 of the developing housing 12.

In the illustrated embodiment, an upstream sealing central piece 406 and a downstream sealing central piece 408 are arranged in relation to the developing operation region 400 in the sleeve member 20. The upstream sealing central piece 406 protrudes toward the developing operation region 400 of the sleeve member 20 in the downward direction from an upper portion joined to the upper portion 208 of front wall of the developing housing 12 (i.e., downwardly directed from the upstream side of the opening 13 as viewed in the rotational direction of the sleeve member 20 indicated by arrow 244), and the downstream sealing central piece 408 protrudes toward the developing operation region 400 of the sleeve member 20 in the upward direction from the lower portion joined to the lower end portion 210 of front wall of the developing housing 12 (i.e., upwardly directed from the downstream side as viewed in the rotational direction of the sleeve member 20 indicated by arrow 244). Both ends of the upstream sealing central piece 406 and of the downstream sealing central piece 408 are substantially in alignment with both ends of the developing operation region 400. The upstream sealing central piece 406 and the downstream sealing central piece 408 are preferably composed of a synthetic resin film such as a polyethylene terephthalate film.

With reference to FIGS. 17 and 19, the upstream sealing side members 410 and 412, downstream sealing side members 414 and 416, and side sealing pieces 418 and 420 are arranged in relation to the non-developing operation regions 402 and 404 on both sides of the sleeve member 20. The upstream sealing side members 410 and 412 are secured at predetermined positions in the protruded wall portions 214 and 216 of both side walls 202 and 204 of the developing housing 12 on the upstream side of the opening 13 as viewed in the rotational direction of the sleeve member 20 indicated by arrow 244, and their lower surfaces are pressed onto the non-developing operation regions 402 and 404 on both sides of the sleeve member 20. The downstream sealing side members 414 and 416 are secured to predetermined positions in the protruded wall portions 214 and 216 of both side walls 202 and 204 of the developing housing 12 on the downstream side of the opening 13 as viewed in the rotational direction of the sleeve member 20 indicated by arrow 244, and their upper surfaces are pressed onto the non-developing operation regions 402 and 404 on both sides of the sleeve member 20. The upstream sealing side members 410 and 412 as well as the downstream sealing side members 414 and 416 are desirably made of a soft sponge. The side sealing pieces 418 and 420 extend along the peripheral surface of the sleeve member 20 between the upstream sealing side members 410, 412 and the downstream sealing side members 414, 416. The upper ends of the side sealing pieces 418 and 420 are joined to the upper edges of the protruded wall portions 214 and 216, the lower ends thereof are joined to the lower edges of the protruded wall portions 214 and 216, and the outer side edges thereof are joined to arcuately-shaped front edges 218 and 220 of the protruded wall portions 214 and 216. Therefore, the side sealing pieces 418 and 420 arcuately extend along the front edges 218 and 220 of the protruded wall portions 214 and 216 between the upstream sealing side members 410, 412 and the downstream sealing side members 414, 416. The inner side edges of the side sealing pieces 418 and 420 are substantially in agreement with the inner side edges of the non-developing operation regions 402 and 404 of both sides. It is important that the gap G is set to be very small (e.g., about 0.05 to about 0.20 mm) between the inner surfaces of the side sealing pieces 418 and 420 (i.e., front edges 218 and 220 of the protruded wall portions 214 and 216) and the peripheral surface of the sleeve member 20, and this gap G is smaller than the thickness DT of the layer of the developing agent 422 that is held on the developing operation region 400 on the peripheral surface of the sleeve member 20 and is exposed through the opening 13 as will be described later. It is desired that the side sealing pieces 418 and 420 are made of a suitable synthetic resin film such as a polyethylene terephthalate film.

As shown in FIG. 18, the above-mentioned developing device is arranged while being opposed to the rotary drum 25 that rotates in the direction indicated by arrow 424. A suitable photosensitive material is placed on the peripheral surface of the rotary drum 25, and electrostatic image to be developed is formed on the photosensitive material. The opening 13 formed in the developing housing 12 is faced to the rotary drum 25, the distance setting rollers 230 and 232 (FIG. 17) rotatably disposed on both sides of the developing housing 12 are brought in contact with both sides on the peripheral surface of the rotary drum 25, and a predetermined gap is defined between the peripheral surface of the sleeve member 20 of magnetic brush mechanism 19 and the peripheral surface of the rotary drum 25. The developing housing 12 contains a magnetic carrier and a toner is fed thereinto. The developing agent 422 consisting of the magnetic carrier and the toner is stirred by the spiral rollers 22 and 24 which are first and second stirrer mechanisms, and the toner is electrified by friction into a predetermined polarity. The spiral roller 22 stirs the developing agent 422 and simultaneously moves it from the right upper side toward the left lower side in FIG. 17, and the spiral roller 24 stirs the developing agent 422 and simultaneously, moves it from the left lower side toward the right upper side in FIG. 17, so that the developing agent 422 is suitably circulated in the developing housing 12.

In the magnetic brush mechanism 19, the developing agent 422 is very strongly held on the central developing operation region 400 of the sleeve member 20 by the magnetic attractive force of a magnetic field established by the magnet member 21, and is moved in the direction indicated by arrow 244 in FIG. 18 through the opening 13 with the rotation of the sleeve member 20. The layer of the developing agent 422 held on the peripheral surface of the sleeve member 20 and carried over to the opening 13 has a predetermined thickness DT as determined by the lower end of upper portion 208 of front wall which is located close to the peripheral surface of the sleeve member 20. The developing agent 422 that is moving passing the opening 13 acts on the peripheral surface of the rotary drum 25, and the electrostatic latent image formed on the peripheral surface of the rotary drum 25 is developed into a toner image.

The developing agent 422 is attracted and held in considerable amounts on the peripheral surface of the sleeve member 20 even on the non-developing operation regions 402 and 404 on both sides of the sleeve member 20. However, most of the developing agent 422 is removed from the peripheral surface of the sleeve member 20 by the action of the upstream sealing side members 410 and 412, and is returned to the developing housing 12 and is not carried over to the opening 13. The developing agent 422, however, remains adheredly in small amounts to the non-developing operation regions 402 and 404 on the peripheral surface of the sleeve member 20, and is carried over to the opening 13. The magnetic attractive force is weak on the non-developing operation regions 402 and 404 since there exists no magnet member 21 inside the sleeve member 20, and the developing agent 422 carried over to the opening 13 while being adhered to the non-developing operation regions 402 and 404 on both sides of the peripheral surface of the sleeve member 20 tends to be removed from the sleeve member 20 due to the centrifugal force created by the rotation of the sleeve member 20. The developing agent 422 that has been removed tends to be scattered outwardly in the radial direction but is prevented from scattering by the side sealing pieces 418 and 420. The developing agent 422 that has been removed further tends to be scattered inwardly in the axial direction from the non-developing operation regions 402 and 404 on both sides. In the developing mechanism improved according to the present invention, the gap G between the inner surfaces of side sealing pieces 418, 420 and the peripheral surface of the sleeve member 20 has been set to be smaller than the thickness DT of the layer of the developing agent 422 that is held on the peripheral surface of the sleeve member 20 on the developing operation region 400 and is exposed through the opening 13. Therefore, the developing agent 422 that has been removed is prevented from scattering inwardly in the axial direction by the layer of the developing agent 422 itself on the developing operation region 400. The developing agent 422 that has been removed further tends to be scattered outwardly in the axial direction from the non-developing operation regions 402 and 404 on both sides. However, the developing agent 422 is prevented from scattering in such a direction by both side walls 202 and 204 of the developing housing 12, or more specifically, by the protruded wall portions 214 and 216. As described above, the developing agent 422 is sufficiently prevented or inhibited from scattering around from the neighborhood of non-developing operation regions 420 and 404 on both sides of the peripheral surface of the sleeve member 20. The above-mentioned operation is carried out in the same manner even for other developing mechanisms 2 to 8.

As will be easily understood from the foregoing description, the developing mechanism having the above constitution can similarly be applied not only to the multi-color developing device bu to the monochromatic developing device as well.

In the illustrated embodiment, the sleeve member in the magnetic brush mechanism is rotated and the magnet member remains stationary. According to the present invention, however, it is also allowable to provide a developing device that employs a magnetic brush of the form in which the magnet member is rotated instead of rotation the sleeve member or in addition to rotating the sleeve member.

In the above-mentioned developing mechanism (above-mentioned further characteristic constitution) employed in the multi-color developing device of the present invention, the gap between the inner surfaces of side sealing pieces and the peripheral surface of the sleeve member has been set to be smaller than the thickness of the layer of the developing agent that is held on the peripheral surface of the sleeve member on the developing operation region. Therefore, the developing agent that has been removed is prevented from scattering inwardly in the axial direction by the layer of the developing agent itself on the developing operation region. Thus, the developing agent is sufficiently prevented or inhibited from scattering around unlike the conventional developing devices in which the developing agent tends to scatter near the non-developing operation regions on both sides. The above-mentioned effects can be achieved even by the developing mechanism in the monochromatic developing device.

The present invention was described above by way of an embodiment. It should, however, be noted that the invention is in no way limited to the above embodiment only but can be varied or modified in a variety of ways without departing from the scope of the present invention.

What we claim is:

1. A multi-color developing device comprising: a stationary frame, a movable frame mounted on said stationary frame so as to be reciprocatingly moved by a moving means in a vertical direction, a plurality of developing mechanisms mounted on said movable frame, wherein by moving said movable frame by said moving means, said developing mechanisms are each selectively located at a developing position and the developing operation is carried out in a different color; and wherein:

a toner container unit is rotatably supported by said stationary frame wherein said toner container unit is adapted to be selectively rotated on an axis through a lower portion of said toner container unit between a retracted position and a fixed position;

said toner container unit includes toner containers of a number equal to that of said developing mechanisms, and toner feeding means that are provided between each toner container and each developing mechanism that corresponds to said toner container in order to feed toner from said toner container to said developing mechanism;

each of said toner feeding means including a vertical toner fall passage means which feeds toner to said corresponding developing mechanism wherein the toner is sent by a vertical toner conveying means from said corresponding toner container to an upper portion of said toner fall passage means, and said toner fall passage means includes an extensible and contractible means having an upper end and a lower end, wherein said upper end is coupled to said upper portion of said fall passage means and said lower end is coupled to said corresponding developing mechanism by detachable connection means; and said extensible and contractible means is positioned so as to extend and contract substantially in a direction in which said developing mechanism moves, said extensible and contractible means being further adapted to permit said toner unit to rotate between said fixed and said retracted positions.

2. A multi-color developing device according to claim 1, wherein said toner container unit includes a support frame means which is rotatably supported by said stationary frame on a rotary support means, said toner containers being supported by said support frame means, said support frame being positioned relative to said stationary frame by a fixing means such that said support frame means is allowed to rotate to said retracted position when said fixing means is released, and wherein said retracted position is determined by a stop means that is provided between said support frame means and said stationary frame.

3. A multi-color developing device according to claim 2, wherein said retracted position of said support frame means is determined by the weight of the toner container unit.

4. A multi-color developing device according to claim 2, wherein said support frame means includes a substantially flat base portion that extends along a lengthwise direction of said base portion and said base portion has side walls that are formed so as to upwardly extend substantially in a vertical direction from both sides of said base portion, support hole means are formed in said side walls at lower positions thereof, said stationary frame includes a main frame that is positioned so as to extend in a substantially perpendicular direction at positions on outer portions of said walls of said support frame means, and said rotary support means includes support pin means that are provided on said main frame so as to protrude toward said side walls of said support frame means and said support hole means that are rotatably fitted to said support pin means.

5. A multi-color developing device according to claim 4, wherein said support hole means has a vertically elongated hole that is formed on the side wall upwardly extending from a lower position, a laterally elongated hole that is in continuity with said vertically elongated hole and extends toward said developing mechanism from the vertex of said vertically elongated hole, and a lengthwise elongated hole that is in continuity with said vertically elongated hole and extends inwardly in the lengthwise direction; and wherein said support frame means is rotatably supported to said main frame by fitting said laterally elongated hole to said support pin means, and the length in the lengthwise direction of said lengthwise elongated hole is longer than a protruding length of said support pins protruding beyond said side walls in the lengthwise direction under the condition where said support frame means is supported by said main frame.

6. A multi-color developing device according to claim 4, wherein contact portions are formed at end portions in the lateral direction of said side walls of said support frame means to extend substantially vertically with respect to the side walls and outwardly, contacting portions are formed at end portions of said main frame corresponding to said contact portions of said support frame means to extend substantially vertically with respect to the main frame and outwardly, said contact portions being located to come in contact with said contacting portions at outer positions of said contacting portions in a direction to separate away from said developing mechanism under a condition where said support frame means is supported by said main frame; and wherein said fixing means are provided between said contact portions and said contacting portions such that said contact portions are releasably fitted to said contacting portions, and said predetermined fixed position of said toner container unit is determined as said contact portions are fitted to said contacting portions.

7. A multi-color developing device according to claim 4, wherein said stop means includes a protrusion means which is formed to extend from at least one of said side walls of said support frame means substantially vertically with respect to the side wall and outwardly in a lengthwise direction, and an engaging means which is formed to protrude from said main frame on a side corresponding to said side wall where said protrusion means is formed, toward said side wall where said protrusion means is formed; and wherein said protrusion means comes in contact with said engaging means and said retracted position of said toner container unit is defined when said fixing means is released and said support frame means is rotated by a predetermined angle with respect to said support pin means.

8. A multi-color developing device according to claim 1, wherein said extensible and contractible means is coupled to a coupling pipe means provided for said developing mechanism though said detachable connection means, wherein an upper end of said coupling pipe means is coupled to a lower end of said extensible and contractible means through said detachable connection means, the lower end of said coupling pipe means is coupled to said developing mechanism, said detachable connection means including a first flange portion formed at said lower end of said extensible and contractible means and an engaging portion formed at the upper end of said coupling pipe, a first protruded portion is formed on the outer periphery of said first flange portion to outwardly extend in the radial direction, a through hole means is formed in said first protruded portion, said engaging portion including a second flange portion formed at the upper end of said coupling pipe means and an engaging groove means formed in an arcuate shape in the upper surface of said second flange portion, said engaging groove means is to constituted as to engage with a part of the outer periphery of said first flange portion and to cover said part of said outer periphery and a part of the upper surface thereof, a second protruded portion outwardly protruding in the radial direction is formed at a position corresponding to said first protruded portion of said first flange portion, an engaging hole means is formed in said second protruded portion, said through hole means and said engaging hole means are in alignment with each other under a condition where said part of said outer periphery of said first flange portion and said part of said upper surface thereof are in engagement with said engaging groove means, and said first protruded portion is fitted to said second protruded portion by a fastening means, whereby the detachable connection means is mounted.

9. A multi-color developing device according to claim 8, wherein said through hole mean sis formed along the circumferential direction of said first flange means in such a manner that one end thereof is open and the other end thereof is closed, and said fastening means includes a lightening means that previously has been engaged with said engaging hole means.

* * * * *

UNITED STATES PATENT AND TRADEMARK OFFICE

CERTIFICATE OF CORRECTION

PATENT NO. : 5,311,260

DATED : May 10, 1994

INVENTOR(S) : Akira NAKAKUMA and Yasuyuki FUKUNAGA

It is certified that error appears in the above-identified patent and that said Letters Patent is hereby corrected as shown below:

On the title page:

ITEM:

[30], Foreign Application Priority Data, was omitted from the patent. Please insert the following:

--March 8, 1991[JP] Japan .....67649
March 8, 1991[JP] Japan .....67651
March 11, 1991[JP] Japan .....69407--

Signed and Sealed this

Fourteenth Day of March, 1995

*Attest:*

*Attesting Officer*

BRUCE LEHMAN

*Commissioner of Patents and Trademarks*